US005293739A

United States Patent [19]

Brockmanns et al.

[11] Patent Number: 5,293,739

[45] Date of Patent: Mar. 15, 1994

[54] METHOD AND APPARATUS FOR SUPPLYING A SLIVER TO A SPINNING POSITION OF A SPINNING MACHINE

[75] Inventors: Karl-Josef Brockmanns, Willich; Reiner Reising, Mönchengladbach; Dietrich Witzler, Hückelhoven; Hans-Werner Schwalm; Theo Lembeck, both of Mönchengladbach, all of Fed. Rep. of Germany

[73] Assignee: W. Schlafhorst AG & Co., Monchen-Gladbach, Fed. Rep. of Germany

[21] Appl. No.: 922,056

[22] Filed: Jul. 29, 1992

[30] Foreign Application Priority Data

Aug. 1, 1991 [DE] Fed. Rep. of Germany ..... 4125476
Feb. 12, 1992 [DE] Fed. Rep. of Germany ..... 4204044

[51] Int. Cl.[5] ..... D01H 4/48
[52] U.S. Cl. ..... 57/263
[58] Field of Search ..... 57/281, 263, 22

[56] References Cited

U.S. PATENT DOCUMENTS 4,150,534 4/1979 Raasch ..... 57/281
4,653,263 3/1987 Stahlecker et al. ..... 57/22 X
4,838,018 6/1989 Hoeber ..... 57/263
4,939,895 7/1990 Raasch et al. ..... 57/263
4,969,323 11/1990 Stahlecker ..... 57/22 X
4,982,563 1/1991 Stahlecker ..... 57/263 X

FOREIGN PATENT DOCUMENTS

2646313A1 4/1978 Fed. Rep. of Germany .
3725265A1 2/1989 Fed. Rep. of Germany .
3802413A1 8/1989 Fed. Rep. of Germany .
3802414A1 8/1989 Fed. Rep. of Germany .
3831637A1 4/1990 Fed. Rep. of Germany .

*Primary Examiner*—Joseph J. Hail, III
*Attorney, Agent, or Firm*—Shefte, Pinckney & Sawyer

[57] ABSTRACT

The present invention provides a manipulator on a sliver can transport carriage which can travel along the spinning positions of a spinning machine to enable the manipulator to take up a leading end of sliver at a defined position on a sliver container and guide the sliver end to a sliver supply location of a spinning position. The manipulator comprises a suction jet on its free end for receiving and holding the leading end of the sliver, an actuation member for engaging and opening the sliver supply location, and a compressed air supply line for blowing the sliver end into the open sliver supply location

16 Claims, 11 Drawing Sheets a)
b)

a)
b)

FIG. 3
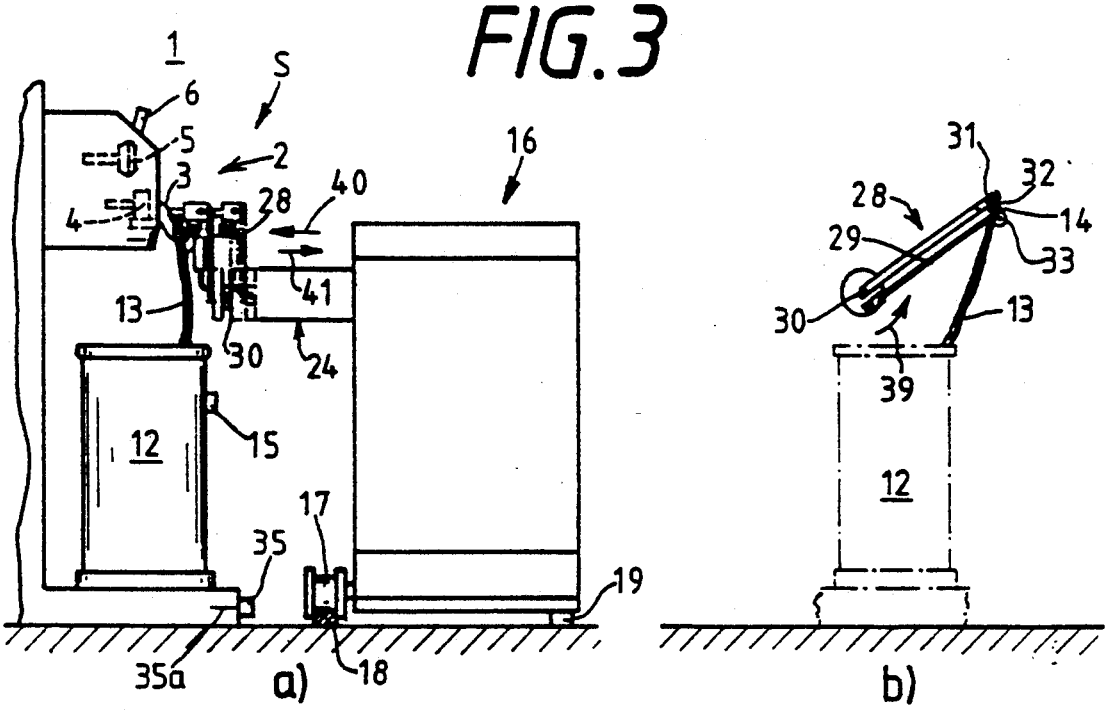
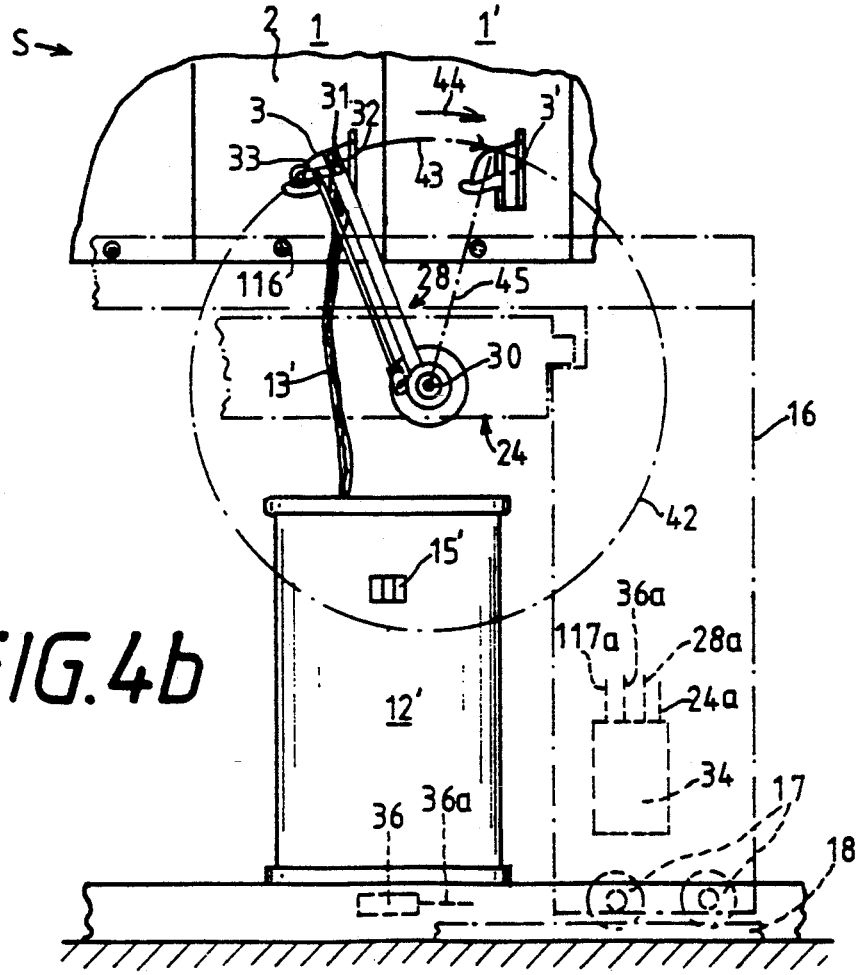
FIG. 4b

METHOD AND APPARATUS FOR SUPPLYING A SLIVER TO A SPINNING POSITION OF A SPINNING MACHINE

BACKGROUND OF THE INVENTION

The present invention relates to a method for supplying a sliver from a filled sliver container to a spinning position of a spinning machine by introducing the leading end of the sliver by a manipulator into a sliver supply location of the spinning position and to an apparatus for carrying out the method.

In textile spinning plants wherein the supply of sliver cans from a drawing frame to a spinning machine already takes place automatically with can transport carriages, it is desirable that the leading end of the sliver should also, in a natural further extension of the automation, be introduced automatically from the full can into the spinning box of the spinning machine.

A device is already known from European patent EP 0,348,678 A1 in which the leading end of a sliver is brought to the spinning position by means of a manipulator assembly. The start of the sliver is obtained in that, during the filling of the sliver from a large can into the can standing at the spinning position, the sliver is torn and the end of the sliver filled into the can at the spinning position is brought in front of the sliver entrance location into the spinning position, e.g., in front of the entrance of the condenser, during which the sliver is mechanically clamped. Compressed air is blown at the spinning position above the sliver intake opening into the condenser through an opening provided especially for this purpose in a canal or conduit of the condenser. The compressed air should, on the one hand, produce an injector action for drawing in the leading end of sliver by suction and on the other hand should blow the leading end of the incoming sliver under the condenser roller. There is the danger in this device and this method that the injector action of the compressed air either is too weak to suction in the presented sliver end, which is no longer held, or the compressed air can be so strong that the sliver is blown in an uncontrolled manner into the opening device.

SUMMARY OF THE INVENTION

The present invention has the object of assuring a reliable and precise automatic supplying of a sliver to a spinning position of a spinning machine which overcomes these disadvantages Briefly summarized, the present invention provides a method and apparatus for automatically delivering a leading end of a sliver from a sliver container to a spinning position of a spinning machine by means of a movable manipulator which, according to the present invention, is equipped to grasp the leading end of sliver by suction at a defined position on the sliver container and hold the sliver end, to move the leading end of sliver into a position in front of the sliver supply location of the spinning position, to open the sliver supply location, to discontinue the suction to release the leading end of the sliver while at the same time generating a forced air flow to blow the released sliver end into the open sliver supply location, and finally to close the sliver supply location, thereby clamping the leading end of the sliver into the sliver supply location. Following operation of the present method and apparatus in this manner, the spinning position may be started with the leading sliver end positioned securely and properly within the spinning position.

In this manner, the manipulator of the present invention grasps the sliver on the new sliver can and guides the sliver automatically through the condenser of the spinning position until in front of the clamping slot defined between the draw-in roller and the clamping table of the spinning position. As a result, the sliver is advantageously guided and handled from the can until into the slot between the draw-in roller and the clamping table by one and the same manipulator, which assures that the leading end of the sliver is introduced at a defined position to the opening device of the spinning box. Instead of a mechanical clamp, the leading end of the sliver is grasped and held by means of suction air. When the manipulator is in its ending position, it opens the sliver supply location and frees the sliver from the suction action. The suction action is generated via an injector valve by means of compressed air which is either taken from the spinning machine, if the manipulator is located on the spinning machine itself or is arranged so that the manipulator can be moved on the machine, or the compressed air may be carried or generated on a can transport carriage on whose can replacement device the manipulator can be attached. In order to release the sliver, the injector valve is switched over so that the compressed air acts on the sliver and, as a result, the leading end of the sliver is blown into the slot between the drawing-in roller and the clamping table.

In a further development of the invention, after the introduction of the leading end of the sliver into the sliver supply location of the spinning position, the latter is operated for a predetermined time during which a certain length of yarn is spun by the spinning position. The quality of the yarn is monitored and, then, the spinning process is stopped and the yarn spun at the spinning position is removed. Thereupon, the spinning position is actuated again and the yarn then spun is wound up and evaluated. These method steps prevent irregularities in the sliver from affecting the yarn which could be produced by means of the handling of the leading end of the sliver, positioning thereof on the can, and the subsequent taking up of the sliver end by the manipulator and introduction thereof into the spinning position. The time which is used for the spinning of the non-evaluated yarn can be a function of the length of the leading end of the sliver, which could experience a change in its cross-section and in its fiber number on account of the clamping and transfer to the spinning position. Once these few centimeters of sliver have been spun to a yarn, the spinning position is stopped after the set time, the winding bobbin lifted off, and the already spun yarn removed by suction by means of the draw-off jets normally present on the spinning positions. A new spinning start then takes place, whereupon the yarn then spun is wound up and evaluated. The method described here assures that no defective yarn is spun which would have to be cut out in the quality monitoring of the yarn. The danger is greatest at the start of the spinning process that due to the irregularity of the leading end of the sliver the yarn does not exhibit the quality which is required of it. Thus, without this start-up procedure, the risk would exist that the spinning process would be disturbed by frequent interruptions conditioned by quality monitoring, which would sharply reduce the effectiveness of the particular spinning position at the start of every new sliver can.

According to another aspect of the invention, after the replacement of the sliver container and the introduction of the leading end of the sliver into the sliver supply location of a spinning position, the production of yarn from the spinning position is recognized as indicating a successful introduction and subsequent drawing in of the sliver. If a yarn is continuously being spun and its presence established, it can be concluded therefrom that the sliver was correctly introduced and is being continuously drawn in. A special sensor which monitors the presence of the incoming sliver can be eliminated in this manner.

In a further development of the invention the initial position of the manipulator relative to the spinning position is corrected after its positioning at the spinning position, e.g., by means of a sliver can transport carriage, in such a manner that when the manipulator is extended, it precisely meets the sliver supply location of the particular spinning position.

The adjustment of the manipulator relative to the spinning position to be served can take place by means of adjustable limit switches, mechanical stops, or with the aid of a stepping motor. In the case of a stepping motor, for example, the setting of the position takes place with the aid of a precisely determined number of step-by-step switchings of the motor. In the case of a drive system with a direct-current motor and a worm gearing in conjunction with a cam switching control mechanism, an automatic fixation of the position of the manipulator takes place by means of the automatic locking of the worm gearing.

In order to achieve a precise alignment of the manipulator, it can also be provided that, in embodiments in which the manipulator is attached to a sliver can transport carriage, e.g., to the can replacement device thereof, the positional deviation of the movable device in relation to the particular spinning position to be served is determined by sensors. The entire can transport carriage can, for example, be aligned by such sensors with respect to a fixed point Inclination meters, so-called inclinators, can also be provided to determine whether the can transport carriage is in plumb or not with respect to the spinning position. In order to align the can transport carriage, height-adjustable wheels can be provided by way of example. With the aid of adjustability in height of the wheels, which is controlled via the sensing device, a can transport carriage which is not precisely positioned can be aligned so that the manipulator exactly registers with the sliver supply location of the spinning position to be served which advantageously avoids misoperations and potential damage to the sliver supply location.

A further development of the invention provides that, when the manipulator is pivoted out of the initial position into the position for grasping the leading end of the sliver, the suction and blowing jet for grasping the sliver is extended, before this position is reached, from a narrower arcuate path of a smaller radius to an arcuate path of a larger radius, is pivoted past the container clamp which holds the leading end of the sliver, and is then pivoted back to a transfer position at the supply location of the spinning position during which the jet is continuously drawn in from the outer pivot path to the original pivot path when passing the area of the container clamp, at which time the suction jet grasps the sliver. The radial movement of the suction jet is coordinated in such a manner with the pivoting motion of the manipulator that the container clamp area in which the leading end of the sliver can be located is passed through. Such a motion of the jet for sucking in the sliver end has the advantage that the sliver is reliably grasped independently of the length of the leading end of the sliver projecting out the clamp. The end of the sliver is thereby suctioned in every instance which renders it easy to introduce the sliver into the sliver supply location of the spinning position. There is the possibility during motion in a fixed pivot path that either the sliver end is missed and the sliver is thus grasped at a position above the leading end which entails the risk that the sliver bends or folds upon itself upon being introduced into the condenser and is not grasped by the draw-in roller. On the other hand, there is the possibility that a sliver that is too short or too thin is not reliably grasped and is lost on the path to the sliver supply location since the fibers which are grasped may be sucked out of the sliver. The present invention assures that in every instance the sliver end is properly grasped at the correct position, regardless of its length and the condition the sliver projects from the clamp.

BRIEF DESCRIPTION OF THE DRAWINGS

FIGS. 1 to 3 each show in view (a) thereof a side elevational view and in view (b) thereof a front elevational view of a can transport carriage;

FIGS. 1*a* and 1*b* show a can transport carriage positioned in front of a spinning position of a spinning machine, a can filled with sliver whose leading end is to be introduced into the spinning position and a sliver manipulator according to the present invention in its initial position;

FIGS. 2*a* and 2*b* are similar to the FIGS. 1*a* and 1*b* but show the manipulator extended and in its lowest position for receiving the leading end of the sliver;

FIGS. 3*a* and 3*b* show the manipulator during the introduction of the leading end of the sliver into the sliver supply location of the spinning position;

FIG. 4*b* shows an elevational view of the manipulator in the possible positions of the sliver introduction into two adjacent spinning positions as viewed from the direction of the can transport carriage toward the spinning machine;

DESCRIPTION OF THE PREFERRED EMBODIMENT

Figure 1:
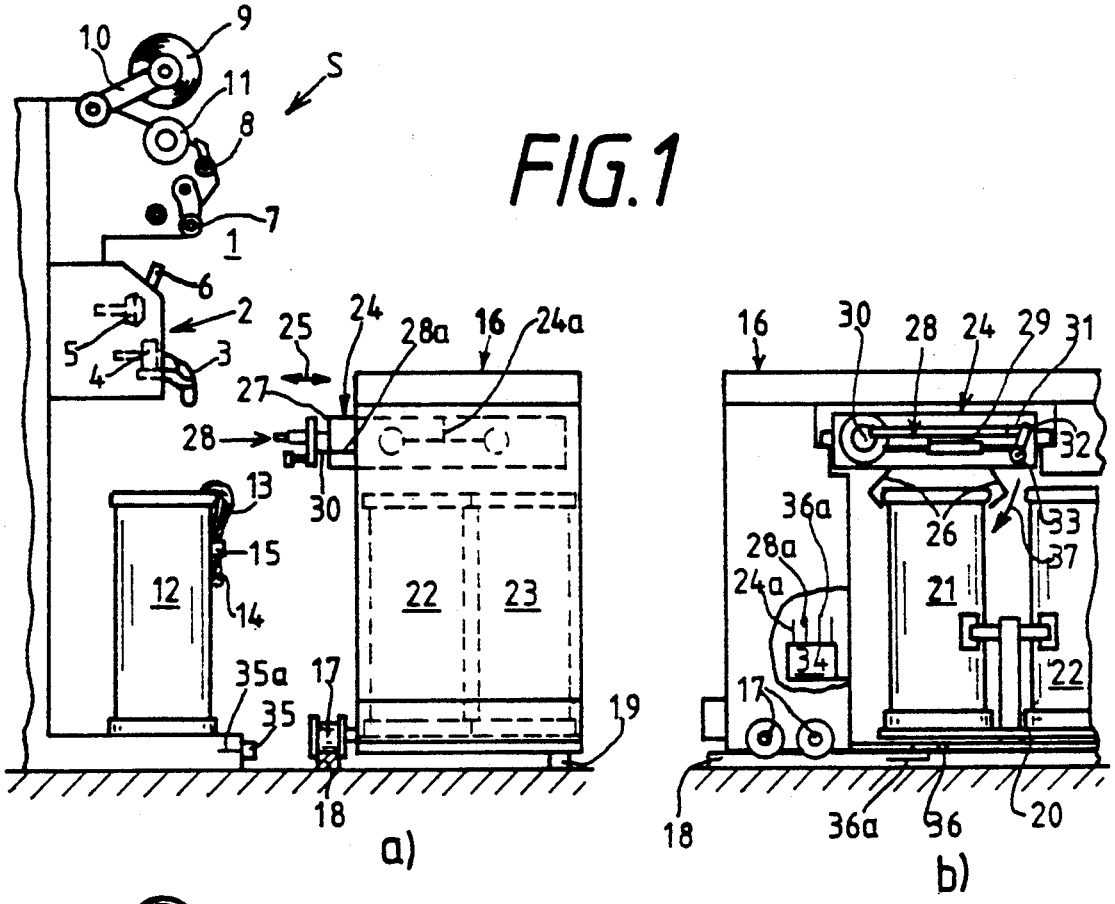

Referring now to the accompanying drawings and initially to FIG. 1, there is shown one representative spinning position 1 of an open-end spinning machine S consisting of a plurality of adjacent spinning positions. So-called spinning boxes 2 are located on each of the spinning positions into which boxes a sliver is supplied via a sliver supply location 3 of an opening device 4, a condenser preferably defining the sliver supply location. The sliver is opened into individual fibers in the opening device 4 which are supplied to a yarn forming element 5 in the form of a spinning rotor, and are spun therein to form a yarn. This yarn is drawn off from the rotor 5 through a draw-off tube 6 by a pair of draw off rollers 7 and wound via a yarn guide 8 onto a cross-wound bobbin 9 which is supported by a bobbin holder 10 in surface driven contact with a driven winding roll 11. However, in the state of the spinning position 1 shown in FIG. 1, since no sliver is being drawn into the spinning box 2 via the yarn supply condenser 3, no yarn is being spun which could be wound onto the cross-wound bobbin 9. Thus, due to the absence of an incoming sliver, a yarn break has occurred and the bobbin holder 10 has lifted the cross-wound bobbin 9 from the winding roller 11.

In FIG. 1*a*, a freshly replaced can 12 filled with a continuous length of sliver 13 is standing under the spinning box 2. The leading end 14 of the sliver 13 is fixed at a defined position on the outer wall of the can 12 formed by a clamp 15, which holds the sliver 13 on the outer wall of the sliver can 12.

The can 12 was previously deposited in this disposition below the spinning box 2 by a can transport carriage 16. Can transport carriages are known from the state of the art and for this reason, their method of operation and their design do not need to be discussed herein in detail. The can transport carriage 16 travels lengthwise alongside the spinning machine S in facing relation to the spinning positions by means of flanged wheel roller 17 supported on a track 18 which extends along the spinning machine and permits an exact guidance of the can transport carriage. The can transport carriage 16 is also supported on at least two other wheels 19 on the side of the carriage 16 opposite the flanged wheel rollers 17.

As can be seen from FIG. 1*b*, the frame of the can transport carriage 16 exhibits a gantry-like design extending over a rotary can supporting table 20 as is known, e.g., from German Offenlegungsschrift DE-OS 38 31 638. Sliver cans 21, 22, and 23 are supported on the rotary table 20. These cans can be full of sliver for delivery to the spinning positions of the spinning machine in need of a replacement supply of sliver or they can also be empty cans from the spinning machine which were replaced with full sliver cans.

A can replacement device 24 is located above the cans disposed on the rotary table 20 and is preferably in the form of a carriage which can be telescopically extended and withdrawn inwardly and outwardly transversely with respect to the longitudinal axis of the can transport carriage 16 over the cans to be replaced under the spinning boxes, as indicated by the double arrow 25. The can replacement device 24 includes grasping elements 26 by which the sliver cans to be replaced are grasped, raised, and transported.

A sliver manipulating arm assembly 28 is located on the front side 27 of the can replacement device 24, i.e., the side of the carriage 16 facing the open-end spinning machine S. The construction and operation of the manipulating arm assembly will be explained in detail hereinafter with respect to FIG. 5. The manipulating arm assembly 28 basically consists of a four-bar lever system 29 pivotably mounted to an articulation joint 30 on the can replacement device 24. The outer end of the manipulating arm assembly carries a head 31 having a suction and blowing jet or nozzle 32 as well as an actuator 33 for opening the sliver supply condenser 3 on a spinning box 2 for introducing the sliver thereto.

The operation of can transport carriage 16 is controlled via a regulating and control system of the spinning machine, which is not shown in detail herein. This control system communicates with a control unit 34 on the can transport carriage 16. In order to replace a can which has become empty with a full can in any spinning position of the spinning machine, the can transport carriage 16 is signalled to the corresponding spinning position by the spinning machine control system via a signal lead 35*a* to a signal transmitter 35 on the spinning machine frame. A receiver 36 on the can transport carriage 16 retransmits the received signal via a signal lead 36*a* to the control unit 34 of the can transport carriage 16. Further details regarding aspects of the control of the can transport carriage 16 and the can replacement operation can be gathered, e.g., from German Offenlegungsschrift DE-OS 38 31 683.

As aforementioned, FIGS. 1*a* and 1*b* show the can transport carriage 16 positioned in front of the spinning position 1. A can 12 filled with sliver 13 has been deposited on the spinning position. The leading end 14 of the sliver 13 is held fixed in the clamp 15 on the outer wall of the sliver can 12 and has a defined length below the clamp 15 so that it can be grasped by the manipulating arm assembly 28. In addition, the can 12 is precisely positioned in such a manner that the clamp 15 with the sliver 13 is facing the can transport carriage.

Figure 2:
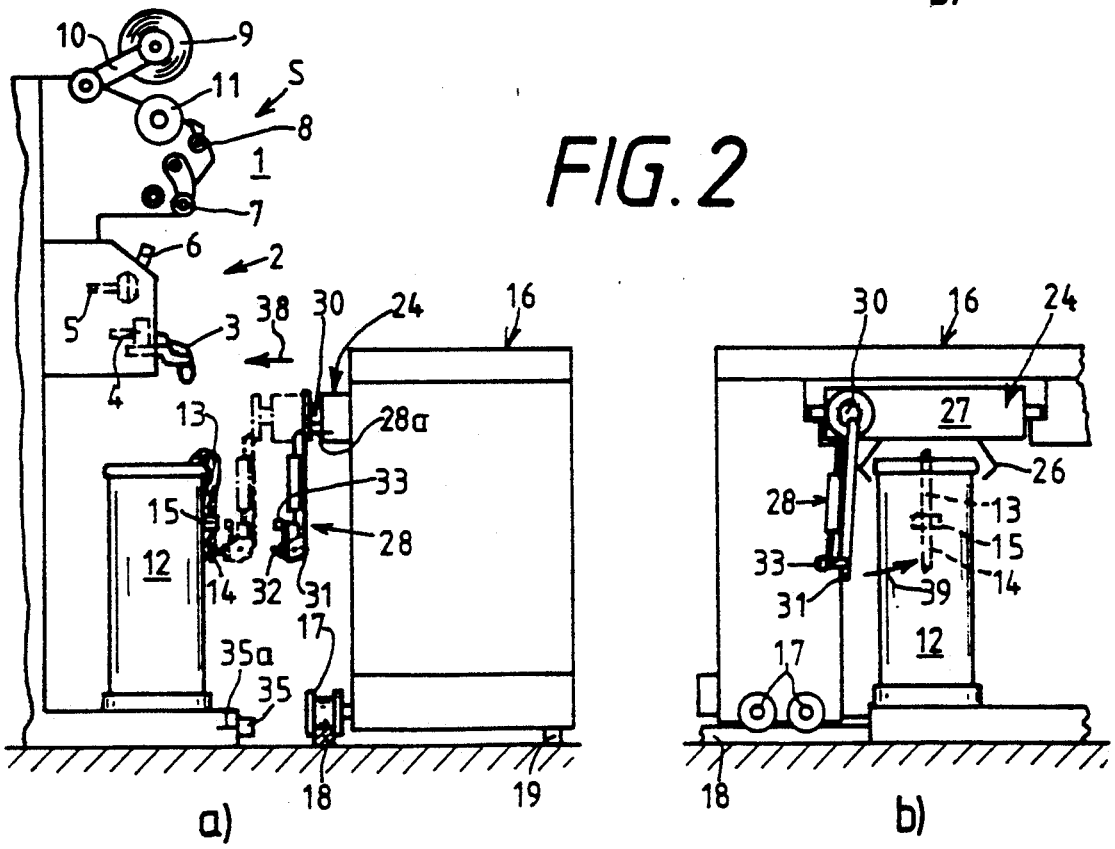

The introduction of the sliver 13 into the condenser 3 of the spinning position 1 with the aid of the manipulating arm assembly 28 takes place as follows. As is apparent from FIGS. 1*a* and 1*b*, the manipulating arm assembly 28 lies in an initial starting position extending horizontally across the front side 27 of the can replacement device 24. The manipulating arm assembly 28 receives a signal from the control unit 34 via a signal lead 28*a* to pivot out of its initial starting position in the direction of the arrow 37 by approximately 90° downward. The pivot angle amounts to somewhat over 90° so that the manipulating arm assembly 28 pivots past the sliver can 12 standing in front of it, as can be seen from FIG. 2*b*. Once the manipulating arm assembly 28 has reached this position, the can replacement device 24 receives another signal from the control unit 34 via a signal lead 24*a* to extend sufficiently in the direction of the can 12, as indicated by the arrow 38 in FIG. 2*a*, until the suction and blowing jet 32 is located at the same height as the leading end 14 of the sliver 13. This position of the manipulating arm assembly 28 is shown in dotted lines in FIG. 2*a*. The suction jet 32 is then actuated and the manipulating arm assembly 28 is pivoted back in the direction of the arrow 39 in FIG. 2*b*, during which the suction jet 32 grasps the leading end 14 of the sliver 13 thereby and draws it out of the sliver clamp 15 which is open in the pivot direction 39 on the sliver can 12.

The manipulating arm assembly 28 is pivoted upwardly with the leading end of the sliver 13 held by the suction jet 32, above its initial starting position until the head 31 is positioned opposite the spinning box 2, into whose sliver supply condenser 3 the end 14 of the sliver 13 is to be introduced. The exact positioning of the manipulating arm assembly 28 can take place either with the aid of a stepping motor by incremental positional measurement, or by means of mechanical positioning aids on the spinning box 2 or on the can transport carriage 16 which actuates a limit switch.

FIGS. 3*a* and 3*b* show the manipulating arm assembly 38 in its final upwardly angled position opposite the spinning box 2. The can replacement device 24 is now shifted in the direction of the arrow 40 toward the spinning box 2 until the suction and blowing jet 32 as well as the actuator 33 engage the condenser 3. The condenser 3 is pivoted sufficiently by means of the actuator 33 that a clamping table of the sliver supply condenser 3 is raised from a draw in roller of the opening device 4. The suction and blowing jet 32 is extended sufficiently that the leading end 14 of the sliver 13 rests in front of a slot-like opening defined between the draw-in roller and the clamping table. Then, the suction and blowing jet 32 is switched from suction operation to emission of compressed air so that the compressed air blows the leading end 14 of the sliver 13 into the slot. The transfer of the sliver will be explained in greater detail hereinafter with respect to FIGS. 5 to 7.

Once the leading end 4 of the sliver 13 has been introduced into the spinning box 2, the actuator 33 and the suction and blowing jet 32 are withdrawn from the condenser 3. Thereafter, the can replacement device 24 is also withdrawn in the direction of the arrow 41 into the can transport carriage 16 in its initial position. Then, the manipulating arm assembly 28 pivots clockwise (as viewed in FIGS. 1-3) back into its initial starting position horizontally positioned at the front side 27 of the can replacement device 24.

After the introduction of the leading end 14 of the sliver into the sliver supply condenser 3 of the spinning position 1, the latter is operated for a predetermined time to spin a certain length of yarn in this time. The spinning process is then stopped and the yarn spun in the spinning position is removed. Then the spinning position is reactuated and the yarn which is then spun is wound and evaluated to ascertain whether successful drawing in of the sliver is occurring.

Figure 4A:
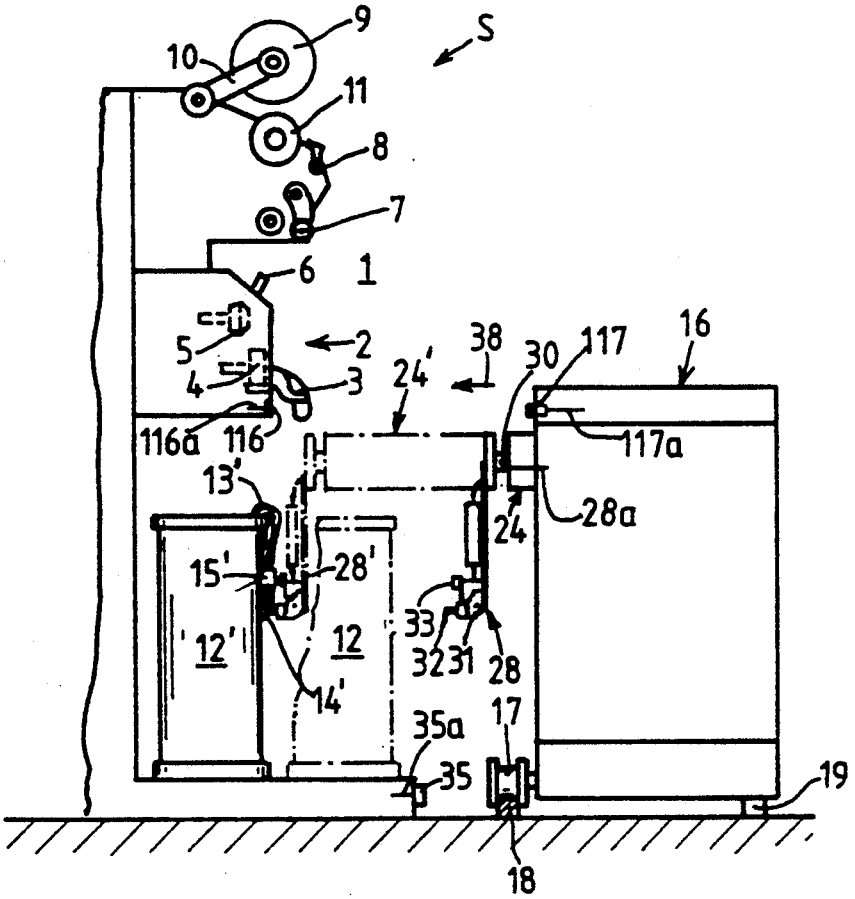
FIG. 4*a* shows a side view of a spinning machine with sliver cans arranged in a double row and a can transport carriage.

FIGS. 4*a* and 4*b* show an embodiment of a can transport carriage which is also designed for use in connection with spinning machines wherein sliver cans are arranged in a double row below the spinning positions of the spinning machine and is adapted for replacement of sliver cans which stand in the second row of such a double row of cans. FIG. 4*a* shows a side view of such a spinning machine in which the double row of sliver cans can be seen below the spinning positions. The sliver cans 12 and 12' stand below two adjacent spinning stations. In normal operation, the sliver from the front sliver can 12 should run into the spinning position 1 and the sliver from the rear sliver can 12' should run into the adjacent spinning position 1' located on the right next to the spinning position 1 (FIG. 4*b*).

In FIG. 4*a*, the can transport carriage 16 is shown in the same position as described above with respect to FIGS. 2*a* and 2*b*. In contrast to the description of FIGS. 2*a* and 2*b*, however, the sliver can 12 has been temporarily removed from its location below the spinning box in order to make possible the reception of the sliver end on the sliver can 12' by the manipulating arm assembly. To this end, the can replacement device 24 has been extended into position 24' so that the manipulating arm assembly 28 is in position 28'. The suction and blowing jet 32 grasps the leading end 14' of the sliver 13' on the sliver can 12' in order to draw the sliver 13' out of the clamp 15' and introduce it into the sliver supply condenser 3' of the spinning position 1'. Since the sliver can 12' is located below the spinning boxes, the can replacement device 24 must be withdrawn sufficiently after the grasping of the end 14' of the sliver 13' that an unobstructed pivoting of the manipulating arm assembly 28 in the direction of the spinning boxes is possible.

FIG. 4*b* is a view from the direction of the can transport carriage 16 showing the spinning boxes 2 of the spinning machine S and the manipulating arm assembly 28 positioned in front of them for introducing the sliver. As is apparent from the indicated contour of the can transport carriage 16, it is positioned in such a manner in front of the spinning machine S that the can replacement device 24 is in a position wherein it is capable of replacing two successive sliver cans from which two adjacent spinning positions 1 and 1' are supplied with sliver. The left spinning position 1 should be supplied with sliver from the sliver can 12 (FIG. 4*a*). In the drawings, this sliver can has been omitted in order to facilitate an explanation of the introduction of the sliver from the sliver can 12' standing behind it into the spinning position 1'.

Starting with FIG. 4*a*, FIG. 4*b* shows the situation in which the manipulating arm assembly 28 is pivoted in the direction of spinning position 1'. As is apparent from FIG. 4*b* the articulation joint 30 around which the manipulating arm assembly 28 rotates is arranged on the can replacement device 24 in such a manner that the head 31 can be disposed upon a rotary motion of the manipulating arm assembly 28 about the joint 30 at either of the sliver supply condensers 3,3' of the two adjacent spinning positions 1,1'. A circular arc 42 designates the rotational path of the suction and jet 32. As is apparent from the course of the circular arc 42, the blowing jet passes immediately adjacent both the condenser 3 of the spinning position 1 and the condenser 3' of the spinning position 1'. In FIG. 4*b*, the manipulating arm assembly 28 has just reached the position in its circular path 42 in which the suction and blowing jet 32 stands opposite the condenser 3 of the spinning position 1. In order to be able to subsequently assume the corresponding position in front of the condenser 3' of the spinning position 1', the manipulating arm assembly 28 must still be pivoted through an arc 43 in the pivotal direction indicated by the arrow 44, whereupon the manipulating arm assembly 28 reaches the position 45 shown in dotted lines.

It is apparent from the embodiment illustrated in FIGS. 4*a* and 4*b* that the logical arrangement of the rotational axis of the manipulating arm assembly 28 on the can replacement device 24 offers the possibility of serving two adjacent spinning positions from one position of the can transport carriage 16 in the case of spinning positions whose sliver cans are located in positions standing successively below the two spinning positions. The positioning of the manipulating arm assembly can take place via the control unit 34 on the can transport carriage 16 based on communications between transmitter and receiver devices 35,36 on the spinning machine and on the can transport carriage, respectively. For example, the alignment of the manipulating arm assembly can take place with the aid of position marks 116 on the spinning boxes 2 of the spinning positions 1,1', which will be discussed in more detail hereinafter in the description of FIGS. 5 and 9.

Figure 5:
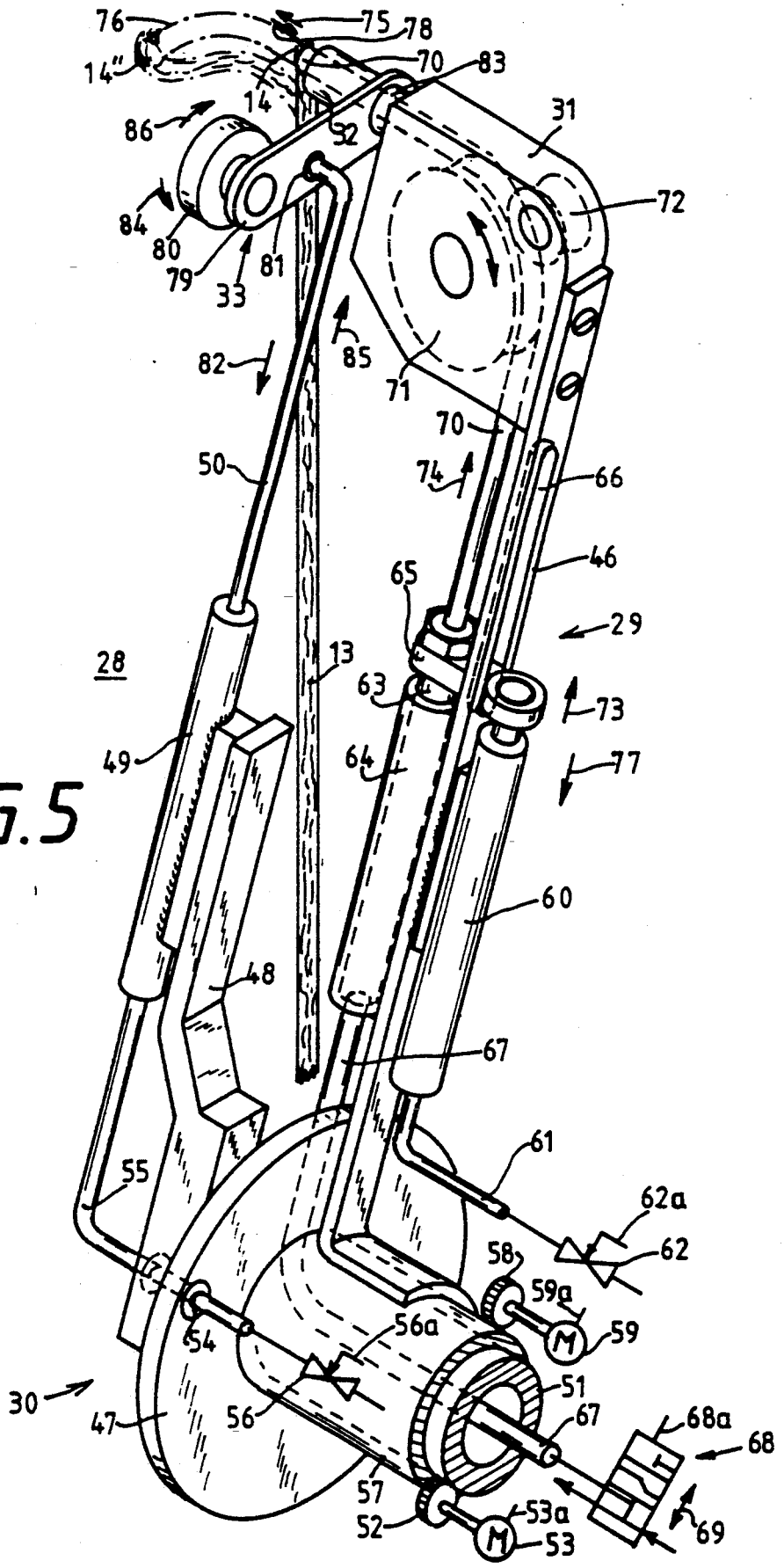
FIG. 5 is a perspective view of the sliver manipulator of the present invention.

The construction of the manipulating arm assembly 28 is best seen in FIG. 5. The manipulating arm assembly 28 consists of a four bar lever system 29. The articulation joint 30 defines the point of rotation about which the manipulating arm assembly rotates on the front of the can replacement device 24. The articulation joint 30 carries both a holder 46 for the head 31 as well as a lever connection consisting of a disk 47 for another holder 48 which carries a pneumatic cylinder 49 connected via an actuation rod 50 to the actuator 33 for the condenser 3. The disk 47 is mounted directly with a hollow shaft 51 in the articulation joint 30 in the front side 27 of the can replacement device 24, which mounting is not shown in detail. The drive for the rotary motion of the manipulating arm assembly takes place via a non-positive connection 52 between the hollow shaft 51 and a motor 53 which is connected to the control unit 34 via a control lead 53*a*. The holder 48 is rotatably mounted on the circumference of the disk 47 at a pivot point 54. A supply line 55 for delivering compressed air to the actuating pneumatic cylinder 49 extends through the pivot point 54 and a controllable valve 56 is located in the air supply line 55. The valve 56 is connected via control lead 56*a* to the control unit 34 of the can transport carriage 16.

The holder 46 for the head 31 is fastened to a sleeve 57, which surrounds the hollow shaft 51 and is rotatably mounted thereon. The sleeve 57 is connected via a non-positive connection 58 to a motor 59 which is controlled via a control lead 59*a* from the control unit 34.

If the holder 46 is rotated by the motor 59, the actuation rod 50 is also rotated in the same direction of rotation because of the four-bar lever system 29, so that actually no motor is necessary for driving the rod 50. However, an individual self-contained drive 53 for the actuation rod 50 is advantageous for fine-tuning the course of motion and for position correction during positioning. Whereas motor 59 for driving the holder 46 with the blowing jet 32 can be a stepping motor, the motor 53 does not have to exhibit this quality. The control lead 28*a* therefore comprises control leads 53*a* and 59*a*.

The holder 46 carries a pneumatic cylinder 60. A compressed air feed 61 for the cylinder 60 is connected with a controllable valve 62, which is connected to the control unit 34 via a control lead 62*a*. A telescopic tube 63, which is guided in a sleeve 64, is withdrawn and extended by means of the pneumatic cylinder 60. The pneumatic cylinder 60 and the telescopic tube 63 are located on opposite sides of the holder 46 with a connection link 65 extending between the telescopic tube 63 and the pneumatic cylinder 60 through a guide slot 66 formed as an elongated oblong opening in the holder 46. The telescopic tube 63 is connected via a supply line 67 with a source of compressed air in which a switchable injection valve 68 is located. The double arrow 69 indicates the switching capability of the injection valve 68 which enables it to be switched over from suction action to compressed air action. This switching is initiated via control lead 68*a* which is connected to the control unit 34. The air supply line 67 to the telescopic tube 63 extends through the hollow shaft 51 of the disk 47. A flexible hose 70 is fastened to the telescopic tube and extends through the head 31, which comprises two opposing guide rollers 71,72 between which the flexible hose 70 is deflected by 90° about the circumference of the guide roller 71. Instead of the rollers 71,72, fixed guide tracks can also be provided.

The head 31 carries the suction and blowing jet 32, which consists of a tube from which the flexible hose 70 centrally extends. If the telescopic tube 63 is withdrawn, the flexible hose 70 extends only a few millimeters out from the tube 32. If the valve 62 is opened due to a signal via the control lead 62*a* so that compressed air flows into the pneumatic cylinder 60, its piston is extended in the direction of arrow 73. The telescopic tube 63 is correspondingly extended via the connecting link 65 and the flexible hose 70 is shifted therewith in the direction of arrow 74. The hose 70 is deflected on the guide roller 71 and thrust in the direction of the arrow 75 out of the tube 32 of the suction and blowing jet. The length 76 of the thrust-out hose 70 is a function of the path which the hose must travel in the sliver supply condenser 3 up to the clamping position of the condenser 3.

In the present description, the leading end 14 of the sliver 13 is attracted by suction at the mouth of the hose 70 extending out of the suction and blowing jet 32. For this action, the injection valve 68 is switched to suction action. If the pneumatic cylinder 60 is actuated and the flexible hose 70 extended from the suction and blowing jet 32 by a length represented by broken line hose section 76, it travels into the condenser 3 (not shown). The leading end 14 of sliver 13 is thereby drawn into the position indicated at 14". Once the final extended position of the hose 70 has been reached, the switchable injection valve 68 is actuated and switched to supply compressed air. Instead of a suction action, compressed air is then discharged at the mouth of the hose 70 and the leading end 14 of the sliver 13 is blown into the clamping position of the condenser 3. Thereafter, the valve 68 is operated to cut off the supply of compressed air and the valve 62 to the cylinder 60 is switched so that its piston is withdrawn in the direction of the arrow 77. The flexible hose 70 is also withdrawn therewith out of the condenser 3 in the direction of the arrow 78 until it has reached its initial starting position in the suction and blowing jet 32.

In order that the leading end 14 of the sliver 13 can be introduced into the condenser 3, the condenser 3 must first be opened so that its clamping table is lifted off the draw-in roller. The actuator 33 is provided to accomplish this end. It consists of a lever 79 which is mounted at one end on the tube 32 of the suction and blowing jet and carries a roller 80 on its opposite end which roller comes to rest in a pocket formed by a specially formed component 102 of the condenser 3. The actuation rod 50, which is connected to pneumatic cylinder 49, is pivotably connected to the lever 79 at hinge point 81. Once the manipulating arm assembly 28 has been positioned at a spinning position and the head 31 delivered to the condenser 3, the roller 80 is also thereby oriented to lay on the specially provided pocket 102 of the condenser 3 ready for its actuation. A signal is transmitted via the control lead 56*a* to the valve 56 to open the valve 56 and deliver compressed air to actuate the pneumatic cylinder 49, drawing the actuation rod 50 in the direction of the arrow 82 into pneumatic cylinder 49. The actuation rod 50 thereby pulls on the lever 79 which pivots around the tube of the suction and blowing jet at the pivot connection 83. The lever movement causes the roller 80 to pivot downwardly in the direction of the arrow 84 and press on the condenser 3, as a result of which the clamping table is raised from the draw-in roller to make it possible to blow the leading end 14 of the sliver 13 into the clamping slot of the condenser. Once such has taken place, the actuation rod 50 is guided back into its initial starting position via the pneumatic cylinder 49, as is indicated by the arrow 85. The lever 79 with the roller 80 pivots in the direction of the arrow 86 back into its initial position. As a result thereof, the condenser 3 is freed and the clamping surface pivots back against the draw-in roller and clamps fast the sliver end 14 which has been blown in. When the actuator 33 has returned into its initial position and the hose 70 has also been withdrawn into its initial position, the manipulating arm assembly 28 can be withdrawn from the spinning box.

Figure 6:
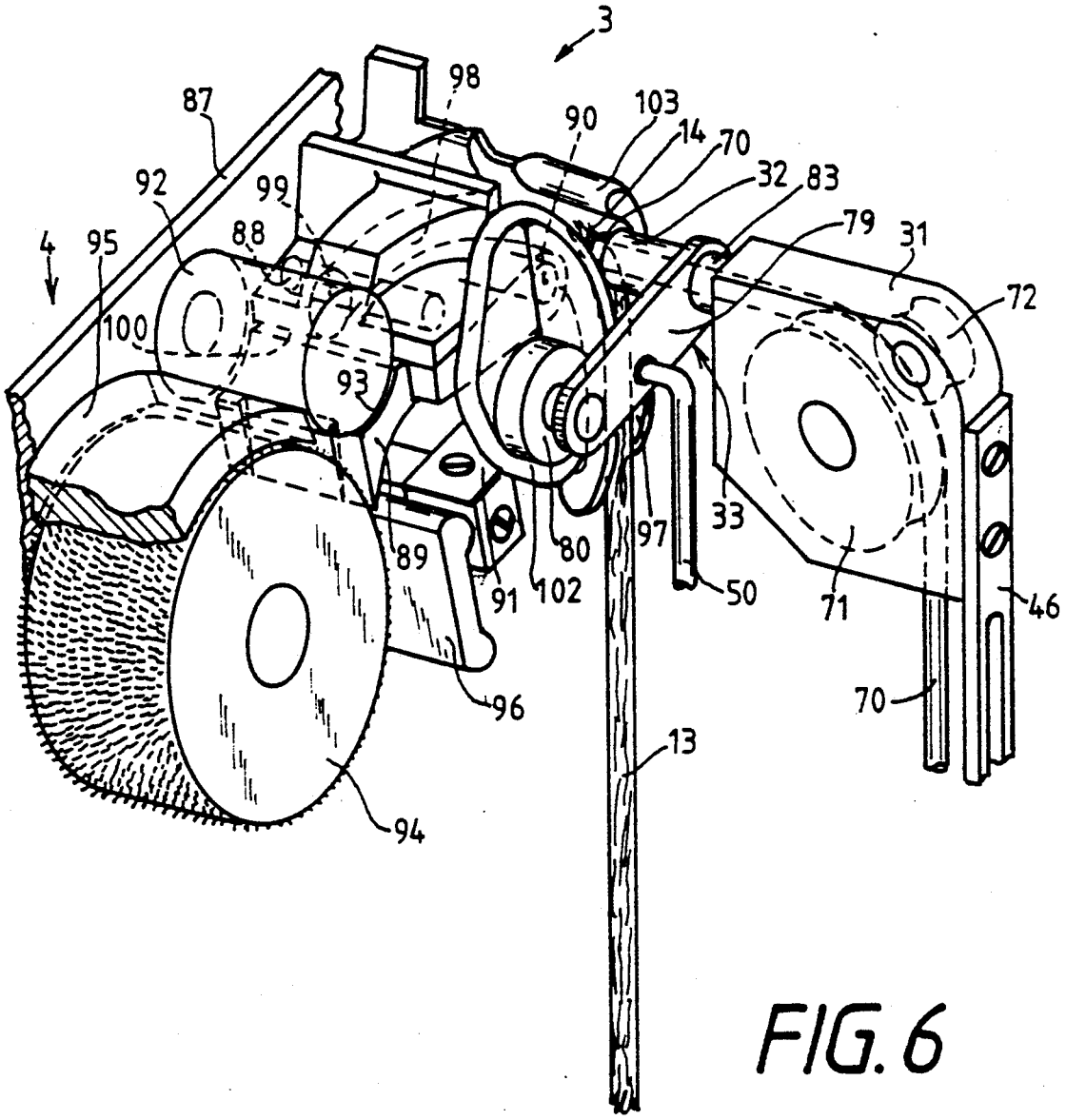
FIG. 6 is a fragmentary perspective view of the manipulator and the spinning position showing the positioning of the manipulator at the sliver supply location.
Figure 7:
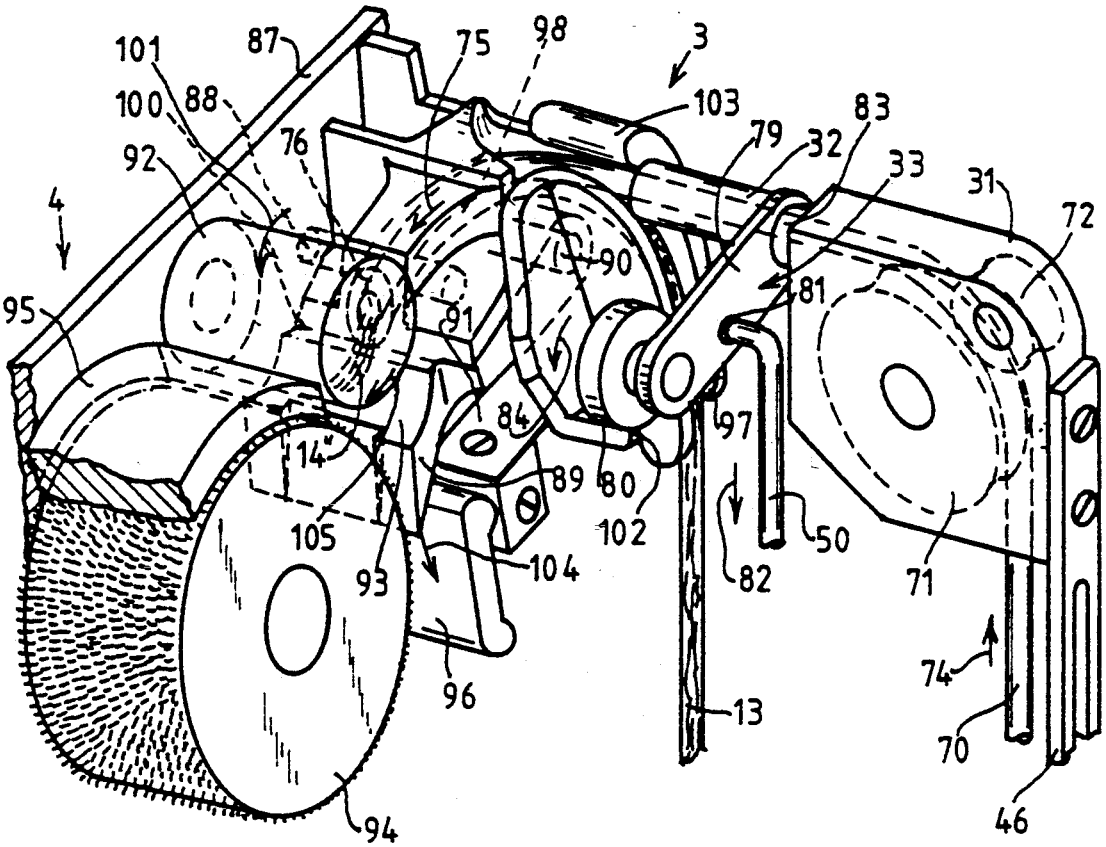
FIG. 7 is a fragmentary perspective view like FIG. 6 showing the opening of the sliver supply location and the introduction of the leading end of the sliver.

The cooperation of the manipulating arm assembly 28 and the sliver supply condenser 3 in a spinning position upon the introduction of the sliver 13 is best understood with reference to FIGS. 6 and 7.

FIG. 6 shows a perspective view of the sliver supply condenser 3 and the opening device 4 as part of a spinning box at one spinning position of the spinning machine. The opening device 4 and the condenser 3 are enclosed in a common housing 87 of the spinning box. The condenser 3 is shown as an individual item in FIG. 8. As seen in FIG. 6, the condenser 3 is pivotably mounted on a shaft 88 in the spinning box housing 87 and is supported on an upper clamping surface of a clamping table 89. The clamping table 89 is mounted so that it can pivot about a shaft 90, which is also fastened in housing 87. The clamping table 89 is biased by a leaf spring 91 against a draw-in roller 92. A clamping slot 93 is thus defined between the upper surface of the clamping table 89 and the draw-in roller 92. An opening roller 94 is located opposite the draw-in roller 92. Only a wall 95 and a contaminant separation wall 96 are shown of the portion of the housing surrounding the opening roller 94 to enhance the visibility of the described components.

Figure 8:
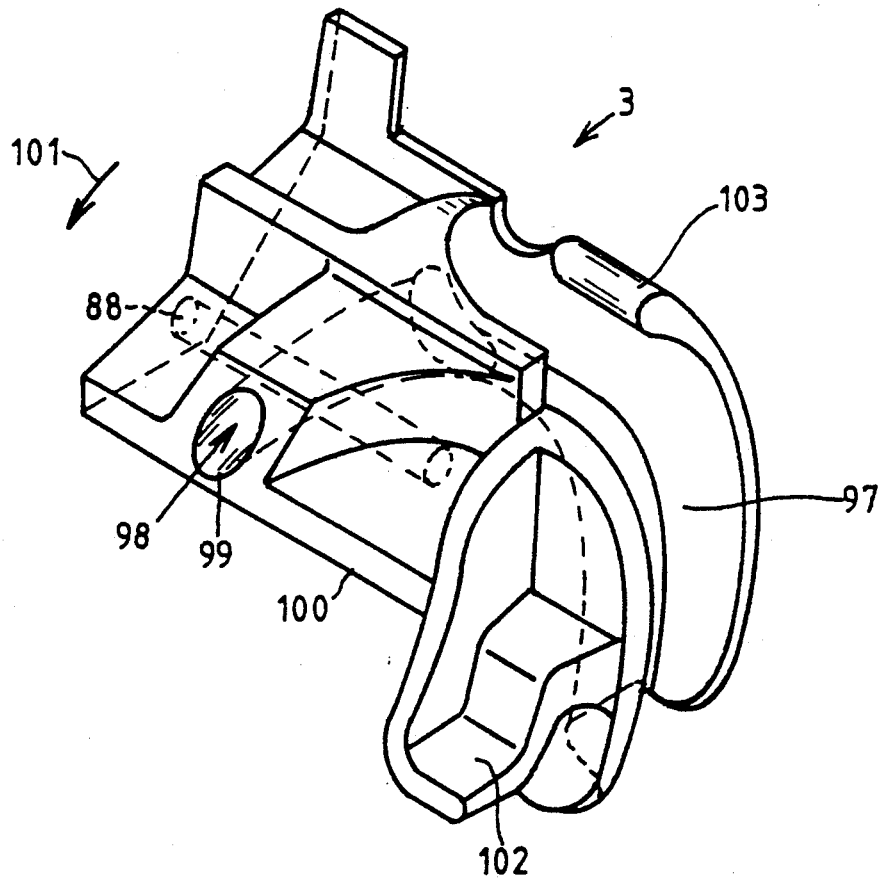
FIG. 8 is a perspective view of the condenser of the sliver supply location.

Due to the position of the opening roller 94 and the direction in which sliver is drawn in from the sliver can, the sliver must be spatially deflected twice at a right angle into the sliver supply condenser 3. Therefore, as shown in FIG. 8, the condenser 3 comprises a groove 97 in which the sliver is deflected vertically from below into a horizontal direction. A closed and tapering canal or conduit 98, which serves for the actual condensing of the sliver, extends at approximately a right angle from the horizontal extent of the groove 97. The outlet mouth 99 of the condenser canal 98 opens opposite the draw-in roller 92. The contour of the condenser 3 is conformed in this area to the contour of the draw-in roller 92. A lower edge 100 of the condenser 3 rests on the clamping table 89. A pivoting motion of the condenser 3 around the shaft 88 in the direction of the arrow 101 is achieved with the actuator 33 as previously described. The actuator roller 80 engages in the pocket 102, which is located on the front side of the condenser 3. The pocket 102 is configured and is located at a sufficient distance from the shaft 88 that upon a force acting on the pocket 102, the condenser 3 executes a counterclockwise pivoting movement in the direction of arrow 101. The condenser's lower edge 100 is thereby pressed on the clamping table 89 to separate it from the draw-in roller 92 so that the clamping slot 93 is opened to receive the sliver. A nose 103 above the groove 97 prevents the sliver from sliding out the groove 97 and functions at the same time as a stop for the manipulating arm assembly 28. The suction and blowing jet 32 can be positioned in its end position on this nose 103.

FIG. 6 shows the introduction of the sliver into the spinning position at the point in time at which the manipulating arm assembly 28 has positioned itself on the spinning position. Only those components of the manipulating arm assembly 28 are shown which directly contact with the condenser 3. The suction and blowing jet 32 is positioned within the groove 97 for the sliver. The roller 80 of the actuator 33 rests in the pocket 102 of condenser 3. The leading end 14 of the sliver 13 is held at the mouth of the nose 70 extending out of the suction and blowing jet 32 and the sliver 13 has already been placed into the vertical extent of the groove 97 of the sliver supply condenser 3. The introduction of the sliver 13 into the spinning box can thus be initiated, as is shown in FIG. 7.

The introduction of the sliver into the spinning box has already been explained with respect to FIG. 5 in the above description of the manipulating arm assembly 28. FIG. 7 shows the manipulating arm assembly 28 in cooperation with the condenser 3 in a spinning position.

In order to introduce the leading end 14 of the sliver 13 up to opening device 4 in the spinning box, the sliver end 14 must first be directed into the clamping slot 93 by the condenser 3, particularly through the condenser canal 98. In order to accomplish this operation, the clamping table 89 must be separated from the draw-in roller 92 to expose a slot between the draw-in roller 92 and the clamping table 89.

In FIG. 7, the actuator 33 has been actuated in order to open the clamping slot 93. Specifically, the actuation rod 50 has been moved downwardly in the direction of the arrow 82 via the pneumatic cylinder 49 shown in FIG. 5. The lever 79 pivots downward thereby about the pivot location 83 on the suction and blowing jet 32 in the direction of the arrow 84. During this pivoting movement, the roller 80 on the end of the lever 79 presses on the pocket 102 of the condenser 3 and the condenser 3 pivots thereby about its shaft 88 and presses with its lower edge 100 on the clamping table 89. The clamping table 89 is pivoted downwardly counter to the biasing force of the spring 91 about its shaft 90 in the direction of the arrow 104, whereby the clamping table 89 separates from the draw-in roller 92 and opens the clamping slot 93.

Next, the telescopic tube 63 is extended via the pneumatic cylinder 60 (see FIG. 5) and the flexible hose 70 is extended therewith in the direction of the arrow 74. The hose 70 is deflected by the guide rollers 71,72, exits from the suction and blowing jet 32 and is deflected by the horizontal portion of the sliver groove 97 into the enclosed condenser canal 98. The sliver is moved thereby in the direction of the arrow 75 through the sliver groove 97 and through the condenser canal 98. Since a suction force is still being exerted at the mouth of the flexible hose 70, the leading end 14 of the sliver 13 is entrained during the path of the hose through the sliver groove and canal 97,98. Under the control of the valve 62, the end of the flexible hose 70 is thrust out the suction and blowing jet 32 by the length 76 sufficiently that the mouth of the hose 70 comes to rest in the exit opening 99 of the condenser canal 98 at which the extension of the hose 70 is stopped and the injection valve 68 switched to direct compressed air to flow into the hose 70. The leading end of the sliver located in the position 14" (FIG. 5) is then abruptly blown thereby into the open clamping slot 93, as is symbolized in FIG. 7 by arrow 105.

In order to clamp the sliver, the actuation rod 50 is re-extended in the direction of the arrow 85 (FIG. 5) so that the lever 79 pivots back clockwise and the actuator 33 releases the condenser 3. The clamping table 89 and therewith the condenser 3 are pivoted back clockwise under the biasing force of spring 91, causing the clamping table 89 to again be pressed against the draw-in roller 92. The clamping slot 93 closes to clamp the sliver so that it will be drawn into the opening device 4 when it is actuated.

In order that the manipulating arm assembly 28 can execute the introduction of the sliver into the sliver supply condenser 3 of a spinning box, the manipulating arm assembly 28 must be initially positioned exactly in front of the spinning position. Once the manipulating arm assembly 28 has reached its final position after executing its pivot movement, the suction and blowing jet 32 as well as the roller 80 of the actuator 33 must precisely engage into the sliver groove 97 and into the pocket 102 during the delivery by means of the can replacement device to the spinning position. An imprecise positioning of the can transport carriage 16 can render impossible a precise positioning of the jet 32 and the actuator roller 80.

Figure 9:
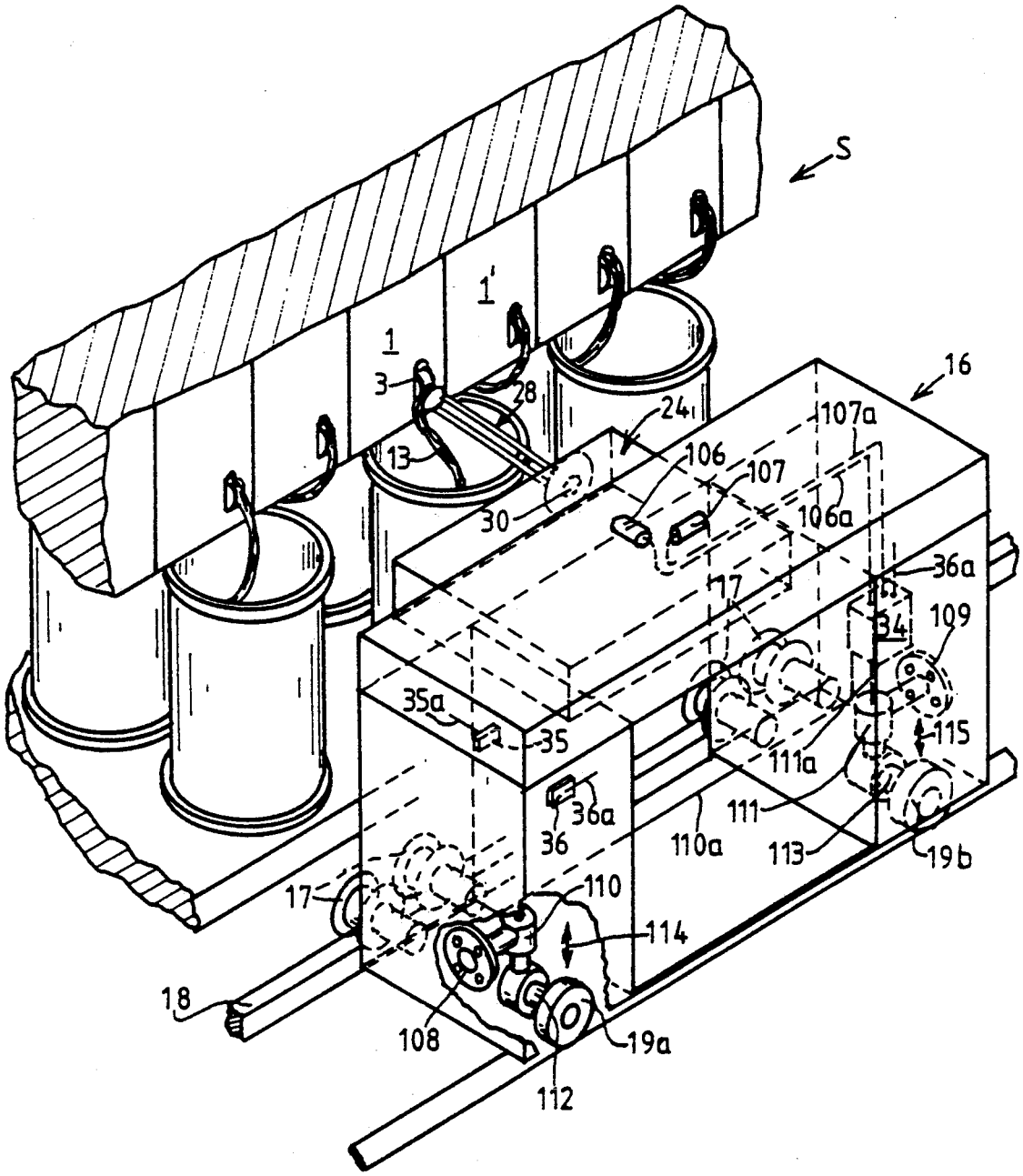
FIG. 9 is a perspective view of a can transport carriage with a positioning device.

For this reason, the can transport carriage 16 is provided in accordance with the invention with a device shown in FIG. 9 which renders possible a precise positioning and alignment of the can transport carriage.

A locally precise positioning of the can transport carriage 16 takes place via the signal transmitter and signal receiver 35,36. The signal transmitter 35 is located as a positioning aid at the spinning position of the spinning machine and the receiver 36 is located on the can transport carriage 16 for aligning the carriage 16. When the signal transmitter and receiver 35,36 are precisely opposite one another, the can transport carriage 16 is locally positioned precisely.

However, when so positioned, the can transport carriage 16 is not necessarily precisely aligned horizontally and vertically so that its can replacement device 24 extends precisely horizontally and is aligned precisely parallel with respect to the spinning machine. In order to make possible a traveling path of the can replacement device 24 in a horizontal plane without deviation, so-called inclinators 106,107 in the frame of the can transport carriage 16 determine the transverse and longitudinal inclination of the can transport carriage 16, respectively, with respect to coordinate horizontal reference axes. Instead of two inclinators, an inclination measuring device can also be provided which is capable of determining the deviation in two coordinate horizontal axes. Instead of being located in the frame of the can transport carriage 16, the inclinators can be installed in the can replacement device 24. The determined deviations from the corresponding coordinate axes are transmitted via the signal leads 106*a* and 107*a* to the control unit 34, which determines the magnitude of the inclination relative to each particular coordinate references axis.

The can transport carriage 16 is supported on the side facing away from spinning machine S on two rollers 19*a*,19*b*. However, the can transport carriage 16 is not supported directly on these rollers. Hydraulic cylinders 110,111 are fastened to the can transport carriage 16 by respective flanges 108,109 either on the chassis or the side walls of the can transport carriage 16 but, in each case, so that a sufficiently large lever path is present opposite the flanged wheel rollers 17. The hydraulic cylinders 110,111 are supported on the respective shafts of the rollers 19*a*,19*b*, the hydraulic cylinder 110 being supported on the shaft 112 of the wheel 19*a* whereas the hydraulic cylinder 111 is supported on the shaft 113 of the wheel 19*b*. The control unit 34 is connected via a control line 110*a* to the hydraulic cylinder 110 and via a control line 111*a* to the hydraulic cylinder 111. Depending on which inclination must be compensated, one of the hydraulic cylinders is signalled from the control unit 34 either to extend and thereby raise the corresponding end of the can transport carriage 16 or to withdraw and thereby lower the can transport carriage 16. With the can transport carriage 16 supported directly on its flanged wheel rollers 17 on the track 18, the track 18 forms a reference line about which the action of the cylinders 110,111 causes the carriage 16 to pivot. The raising or lowering of the can transport carriage continues in each instance until the inclinators do not detect any further deviation from horizontal.

Only after such correction of the inclination of the carriage 16 is a signal transmitted to the manipulating arm assembly 28 to execute the aforedescribed pivot motions for receiving the sliver and for positioning it in front of the sliver supply condenser 3 of the spinning box of the appropriate spinning position. Thus, when the can replacement device 24 with the manipulating arm assembly 28 approaches the sliver supply condenser 3, it is assured that the suction and blowing jet 32 enters the sliver groove 97 and the roller 80 of the actuator 33 enters precisely into the pocket 102 of the condenser 3.

A precise positioning of the can transport carriage 16 can also be performed using optical or mechanical auxiliary means instead of the inclinators. Thus, for example, a rod can first be extended from the can replacement device 24 which rod must strike on a precisely defined position of the spinning box and actuate a contact device before the manipulating arm assembly 28 is actuated. Another positioning arrangement can utilize a thin beam of light, e.g., infrared. In FIGS. 4*a* and 4*b*, for example, such a positioning arrangement is shown in the form of a transmitter 116 on the spinning box or boxes and a receiver 117 on the can transport carriage 16. When the transmitter 116 is activated via a signal lead 116*a* by the control system of the spinning machine, a light beam or other signal is directed toward the precise position occupied by the receiver 117 when the can transport carriage 16 is properly positioned at the spinning position. If the receiver 117 is not in such position to receive the light beam, the alignment of the can transport carriage 16 is adjusted until the receiver 117 receives the light beam and communicates such via a signal lead 117*a* to the control unit 34. The hydraulic cylinder arrangement shown in FIG. 9 can also be used in this embodiment to adjust the alignment of the can transport carriage 16. It is further possible that the locations of the transmitter and receiver can also be reversed. Another alternative is to provide reflectors in the location of the transmitter 116 of FIG. 4*b* from which light is reflected to a photoreceiver on the can transport carriage 16. As soon as a deviation from the optimum position has occurred, the control unit 34 actuates and raises or lowers the can transport carriage 16 via the hydraulic cylinders into the optimum position.

Figure 10:
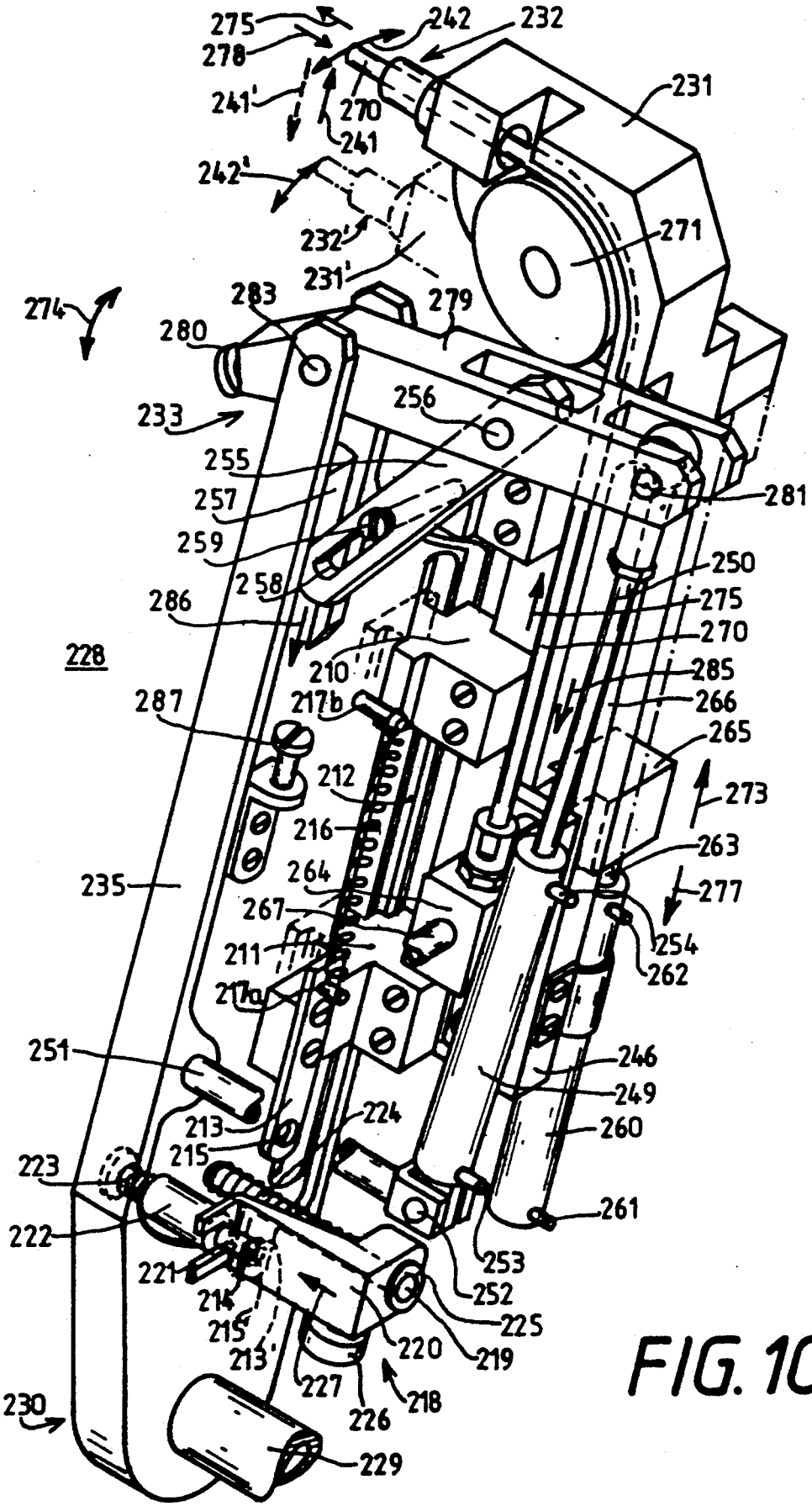
FIG. 10 is a perspective view of another embodiment of sliver manipulator according to the present invention.
Figure 11:
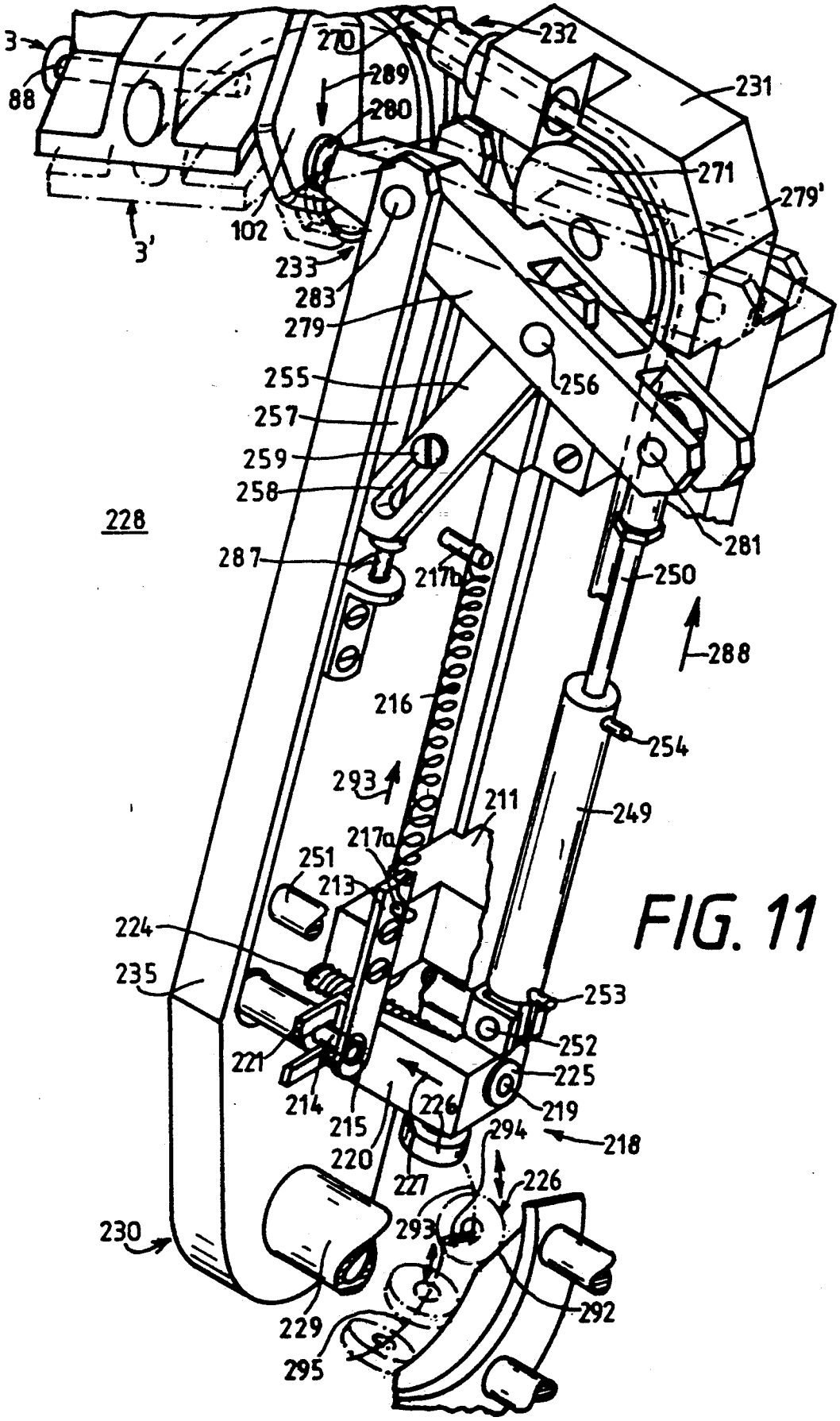
FIG. 11 is a partial perspective view of the sliver manipulator of FIG. 10 in a moved disposition illustrating operation thereof.
Figure 12:
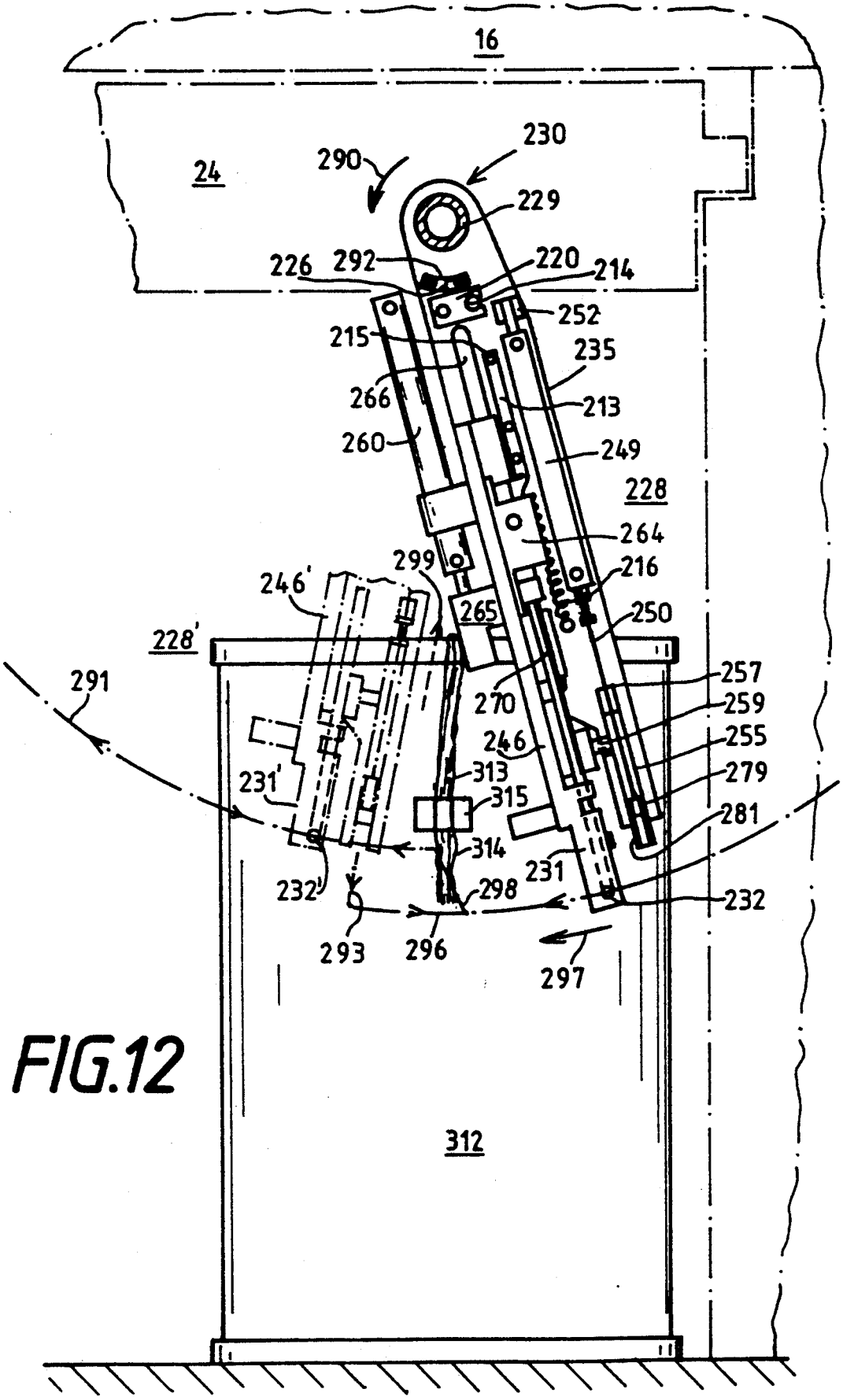
FIG. 12 is a front elevational view of the sliver manipulator can mounted to a can transport carriage, illustrating the sequence of operation thereof.

An alternative embodiment of the manipulating arm assembly 228 is shown in FIGS. 10 and 11, with its operation being illustrated in FIG. 12. The manipulating arm assembly 228 is installed, like manipulating arm assembly 28 shown in FIG. 5, on the front side of the can replacement device 24 of the can transport carriage 16. The pivoting movements of the manipulating arm assembly 228 are actuated by a driven shaft 229, the drive and the drive control of which shaft are not shown. The shaft 229 forms a rotational articulation joint 230 in the operation of the manipulating arm assembly.

The manipulating arm assembly 228 has the following construction. A base plate 235 is permanently connected to the shaft 229. The suction and blowing jet 232 for receiving the sliver on the sliver can and for introducing it into the condenser of the opening device as well as the actuator for actuating the sliver supply are located on this plate. In contrast to the embodiment of the manipulating arm assembly 28 of FIG. 5, the actuator is no longer mounted on the suction and blowing jet and the head 231 of the manipulating arm assembly 228, which carries the suction and blowing jet 232, can shift on base plate 235.

The head 231 with the suction and blowing jet 232 can be retracted and extended perpendicularly, i.e., radially, with respect to the direction of pivoting of the manipulating arm assembly 228. The manipulating arm assembly 28 according to the design of FIG. 5 pivots the suction and blowing jet 32 in a fixed circular arc in the direction of the sliver held in the clamp on the sliver can. A defined predetermined length of the sliver should extend out of the clamp in order that it can be reliably grasped by the suction and blowing jet of the manipulating arm assembly. It is not assured, depending on the fiber length and type, that the leading end of the sliver is always located at the same spot below the clamp. As a result, either an excess length of sliver or, other times, an insufficient length of sliver can be drawn in by the suction action of the suction and blowing jet, which can result, in the first instance, in problems during the introduction of the sliver into the sliver supply condenser and, in the second instance, in failure of the manipulating arm assembly to grasp the sliver properly or to lose it on the pivot path into the transfer position.

The invention therefore provides, as is indicated in FIG. 10, that during the pivoting of the manipulating arm assembly 228 from its initial starting position into the position for grasping the leading end of the sliver, but before this grasping position is reached, the head 231 with the suction and blowing jet 232 is extended in the direction of arrow 241 out of its position 231' depicted in FIG. 10 by dotted lines on the shorter radius pivot path 242' into a position 232 wherein the head 231 follows a pivot path 242 of a larger radius. The suction and blowing jet 232 is then pivoted on outer pivot path 242 past the clamp with the leading end of the sliver, after which the pivotal movement is reversed to travel to a sliver transfer position at the adjacent spinning position. During the pivoting back into the sliver transfer position through the area of the clamp, the suction and blowing jet 232 is continuously drawn in from the outer pivot path 242 in the direction of the arrow 241' to the smaller radius pivot path 242', during which the suction and blowing jet 232 travels through the area in which the leading end of sliver is located. The reception of the sliver is explained hereinafter in more detail with respect to FIG. 12. FIG. 10 shows the manipulating arm assembly 228 with the head 231 extended whereas in FIG. 11 the head 231 is shown retracted during the transfer of the sliver into the sliver supply.

The head 231 carrying suction and blowing jet 232 is of a design comparable to that of the manipulating arm assembly 28 described above. A flexible hose 270, which terminates in the suction and blowing jet 232, is guided in the head 231 via a guide roller 271. In order to introduce the sliver into the sliver supply of the opening device, the flexible hose 270 can be extended in the direction 275 and, after having released the sliver, withdrawn in the direction of the arrow 278 into its original position. The head 231 with the suction and blowing jet 232 rests on a holder 246. Two slide blocks 210,211 are fastened to the holder 246 and are guided in an oblong guide slot 212 in the base plate 235. A pneumatic cylinder 260 is permanently connected to the holder 246. Compressed air connections 261,262 at opposite ends of the cylinder 260 make possible a controlled extension of the piston 263. A slide block 265 is located on the end of the piston 263 and is guided in an oblong guide slot 266 in the holder 246. The slide block 265 is connected on the opposite side of the guide slot 266 to a connection element 264. A supply line 267 for delivering suction and compressed air to the suction and blowing jet 232 empties into the connection element 264 and the flexible house 270 is fastened to the connection element 264.

When the pneumatic cylinder 260 is actuated, the piston 263 is extended causing the slide block 265 to be shifted in the direction of the arrow 273. At the same time, the connection element 264 connected to the slide block 265 is shifted and the flexible hose 270 is extended therewith in the direction of the arrow 275. Such an actuation of the pneumatic cylinder 260 takes place when the sliver is to be introduced into the sliver supply condenser 3. Once the introduction of the sliver has taken place, the piston 263 is withdrawn via the pneumatic cylinder 260 and the slide block 265 is moved therewith in the direction of the arrow 277. The flexible hose 270 is thereby withdrawn in the direction of the arrow 278.

FIG. 10 shows the head 231 with the suction and blowing jet 232 in an extended position. In the withdrawn position, the holder 246 is held with the aid of a bar 213, which is fastened to the slide block 211, by an extendable pin 214 which engages into a hole 215 in the bar 213. The holding position is depicted in dotted lines in FIG. 10 and in this position the bar 213 is located in the position 213', so that the pin 214 can engage into the hole 215 in its position 215'.

A coil spring 216 is fastened at one end to the slide block 211 at a support pin **217*a* and at the other end to the base plate 235 at a support pin 217*b*. When the holder 246 is located in its fixed position held by the bar 213, the spring 216 is under tension. An actuator 218 is provided to release the holder 246. A slide 220 is slidably fastened on a pin 219 and includes a forked portion 221 supported on a bushing 222 from which extends the pin 214 which engages into the hole 215 of the bar 213. The pin 214 and therewith the bushing 222 are held in their position by spring 223. A spring 224, which extends along and around the pin 219, acts on the slide 220. A locking washer 225 secures the slide 220 on the pin 219. The slide 220 also carries a roller 226. During pivoting movement of the manipulating arm assembly 228 into the area of the sliver can, where the sliver is held by a clamp, the roller 226 follows a contoured cam surface 292 (FIGS. 11 and 12**) on the can replacement device 24. This contoured cam surface 292 acts on the roller 226 to press the slide 220 against the biasing force of the spring 224 in the direction of the arrow 227, as a result of which the slide 220 presses with its fork 221 on the bushing 222 against the biasing force of the spring 223 and thereby withdraws the pin 214 therewith out of the hole 215 of the bar 213. The bar 213 is thereby released and the tensioned spring 216 immediately relaxes and pulls the slide block 211 to cause the holder 246 and the head 231 to move into the extended position shown in FIG. 10.

The actuator 233 for actuating the sliver supply condenser 3 is mounted in the base plate 235 and consists of a lever 279 pivotably mounted to the base plate 235 at a hinge point 283. The lever 279 carries a roller 280 on its front end which roller 280 is placed into the pocket of the sliver supply condenser 3, as is shown in FIG. 11.

An actuation piston 250 of a pneumatic cylinder 249 is attached to the other end of the lever 279 at a hinge point 281. The pneumatic cylinder 249 is articulated to the base plate 235 via a shaft 251 which is connected at one end to base plate 235 and carries at the other end a clevis connection 252 pivoted to the pneumatic cylinder 249. The pneumatic cylinder 249 can be controlled in both directions via compressed air connections 253,254 at its opposite ends.

One end of a coupling member 255 is pivotably mounted at a hinge point 256 to the lever 279 approximately centrally between the two hinge points 281,283. The other end of the coupling member 255 is guided in guide channel 257 in the base plate 235. The coupling member 255 comprises an elongate slot 258 in which slidably extends a pin 259 which is permanently connected to the holder 246. Thus, with the aid of the coupling member 255, motions of the lever 279 can be transmitted to the holder 246 and vice versa when the bar 213 is disengaged from the pin 214.

FIG. 10 shows the manipulating arm assembly 228 with the head 231 extended and FIG. 11 shows the manipulating arm assembly 228 with the head retracted. It can be clearly seen that the lever 279 of the actuator 233 assumes two different positions thereby. In FIG. 11, the lever 279 is positioned with the roller 280 placed into the pocket of the sliver supply condenser 3, with the position of the lever 279 and the roller 28 according to FIG. 10, wherein the sliver supply condenser 3 is caused to be opened in order to be able to insert the sliver, being shown in dotted lines. It can be clearly recognized that the pin 259, which connects the lever 279 to the holder 246, can move freely in the slot 258 of the coupling member 255 during this actuating motion.

On the other hand, when the head 231 is extended, the pin 259 also travels and actuates, by means of its disposition within the upper end of the slot 258, the coupling member 255 to raise the lever 279. In order to permit this movement of the lever 279, the pneumatic cylinder 249 is rendered pressureless via a control device which is not shown here. The position which actuator 233 assumes with its lever 279 in FIG. 10 does not have to coincide with the actuating position as shown in FIG. 11. Once the head 231 has been extended, the roller 280 does not rest on the sliver supply condenser. The head 231 is located in a searching position for the leading end of the sliver and the actuator 233 is therefore free to move.

The pneumatic cylinder 249 fulfills a double function in the present design of the manipulating arm assembly 228. On the one hand, it serves to actuate movement of the actuator 233 and, on the other hand, it serves to retrieve head 231 via the holder 246 by means of the coupling member 255 and the pin 259.

If the piston rod 250 is retracted via the pneumatic cylinder 249 in the direction of the arrow 285 in the position of the head 231 and of the lever 279 as shown in FIG. 10, the upper shoulder of the slot 258 of the coupling member 255 engages the pin 259. At the same time, the coupling member 255 presses forwardly against the guide channel 257 on the base plate 235. Guided by the guide channel 257, the coupling member 255 slides on the base plate 235 in the direction of the arrow 286 and engages the pin 259 therewith and the pin 259 in turn causes the holder 246 to be retracted with the head 231. At the same time, the bar 213 is thrust downwardly to dispose its hole 215 over the pin 214 which is still retracted by the slide 220.

Once the head 231 has been completely withdrawn and the roller 226 leaves the cam surface 292, the slide 220 is moved outwardly on the pin 219 by the spring 224 freeing the fork 221 from the pin 214 so that it is extended by its spring 223 into the hole 215 of the bar 213, thus fixing the holder 246. Screw 287 on the base plate 235 designates an adjustable stop for the coupling member 255 to ensure proper orientation of the bar 213.

When the holder 246 is in this locked position, the lever 279 of the actuator 233 can move freely, as already explained, if it is actuated via the piston rod 250 by means of the pneumatic cylinder 249. The lever 279 then pivots about the hinge point 283 and the roller 280 moves in an arcuate path indicated by the arrow 274.

The actuation of the sliver supply condenser for the introduction of the sliver to the opening device is best understood with reference to FIG. 11. Once the manipulating arm assembly 228 has been pivoted into the transfer position for the sliver, the head 231 with the suction and blowing jet 232 is located in its retracted position of FIG. 11. In order to insert the sliver into the condenser, only the flexible hose 270 is extended from the suction and blowing jet 232 on the head 231 and then the hose 270 is retracted again after the sliver insertion. To this end, the pneumatic cylinder 260 is actuated, which shifts the connection element 264 with the flexible hose 270 within the slot 266 in the holder 246 (FIG. 10).

The holder 246 is fixed by the bar 213 to the pin 214. If the manipulating arm assembly 228 pivots into the position of the sliver supply condenser on the spinning position, the lever 279 of the actuator 233 for the sliver supply condenser is pivoted away on the path 274 in the direction away from the articulation joint 230 into the position shown in FIG. 11 which positions the roller 280 to engage in the pocket 102 of the condenser 3. This disposition corresponds to the disposition of the manipulating arm assembly 28 in FIG. 6.

In order to actuate the condenser 3, the pneumatic cylinder 249 is actuated through the compressed air supply lines 253,254 via a control device (not shown) to cause the piston rod 250 of the pneumatic cylinder 249 to be extended in the direction of the arrow 288. Since the piston rod 250 is attached to the lever 279 of the actuator 233 at the hinge point 281, the lever 279 is pivoted downwardly about the hinge point 283 in the direction of the arrow 289 into an actuating position indicated in dotted lines in FIG. 11. As a result, a force is exerted on the pocket 102 and the sliver supply condenser 3 is pivoted about its shaft 88. This movement of the condenser 3 causes its clamping table to be separated from the draw-in roller making possible the introduction of the leading end of the sliver into the condenser (which is not shown here but is described in detail above with respect to FIGS. 5 and 6). The insertion of the sliver by extending the flexible hose 270 from the suction and blowing jet 232 as well as the withdrawal of the hose 270 into its initial position take place exactly as has already been described in the embodiment of the manipulating arm assembly 28 in FIGS. 5–7, and therefore need not be repeated.

During this actuation of the sliver supply condenser 3, the holder 246 is not coupled to the actuator 233 since the pin 259 can move freely in the slot 258 of the coupling member 255 while the lever 279 is being pivoted.

The operation of the manipulating arm assembly 228 to locate the leading end of the sliver on a sliver container will now be explained with respect to FIGS. 11 and 12. In FIG. 12, the can transport carriage 16 is in the proper position for replacing a sliver container and for supplying the sliver to a spinning position. A can 312 is standing ready in front of a spinning position (not shown) for supplying the sliver into the sliver supply condenser (also not shown). The leading end 314 of the sliver 313 contained within the can 312 hangs over the upper lip of the container 312 and is held in a clamp 315 at a defined position on the outer wall of the sliver container. The sliver end 314 should hang from the clamp 315 a defined length as a result of the previous preparation of the sliver container in a preparation station (not shown).

FIG. 12 shows the disposition in which the manipulating arm assembly 228 is located in an initial position in order to receive the leading end 314 of the sliver 313 by means of the suction and blowing jet 232. The manipulating arm assembly 228 has been pivoted counterclockwise in the direction of the arrow 290 out of its resting position (not shown). The head 231 with the suction and blowing jet 232 moves in a circular arc 291, corresponding to the circular arc 242' in FIG. 10. Before reaching the clamp 315, the roller 226 of the slide 220 engages the contoured cam surface 292 located on the front side of the can replacement device 24. The cam surface causes the slide 220 to be pressed in the direction of the arrow 227 (FIG. 10) and therewith engages and retracts the pin 214 with the fork 221 to free the bar 213 so that, under the biasing force of the spring 216, the holder 246 together with the head 231 and the suction and blowing jet 232 connected therewith moves outwardly in the direction of the arrow 293.

FIG. 11 schematically illustrates the roller 226 moving in its circular path 293 into initial engagement with the oblique edge of the cam surface 292 and then moving as a result along the path 294, as a result of which the slide 220 is actuated. The slide 220 is held in its actuating position as long as the roller 226 remains in engagement with the cam surface 292 corresponding to the path of movement 295.

This extension of the head 231 with the suction and blowing jet 232 into a radially outward pivot path 296, corresponding to the path 242 in FIG. 10, is shown in FIG. 12 by the arrow 293. The manipulating arm assembly 228 then continues to pivot into the position shown in full lines in FIG. 12, which, viewed in the direction of pivoting of the manipulating arm assembly, is located beyond the clamp 315. In this position, the suction and blowing jet 232 is actuated via controls which are not shown to generate a suction air force at the mouth of the flexible hose 270. The manipulating arm assembly is then pivoted in the reverse direction of the arrow 297 into the position for supplying the sliver to the condenser 3. Shortly before reaching the clamp 315, the lever 279 is withdrawn via a suitable control (not shown) by means of the pneumatic cylinder 249 at such a speed that the suction and blowing jet 232 travels through the path 298 which assures that the leading end of the sliver 314 is grasped in any case, regardless of whether it was cut too long or too short within a tolerable range. It is also assured that only the leading end of the sliver is grasped and that no excess sliver is located in front of the suction and blowing jet in the case of a leading sliver end which is too long, which would make it difficult or impossible to properly deliver the sliver into the condenser 3, e.g., because of a tendency of the long sliver end to fold back upon itself.

When the lever 279 is pivoted about the hinge point 283, the pin 259 is engaged by the coupling member 255 and the holder 246 and the head 231 are withdrawn therewith in the direction of the arrow 299. After the head 231 has been withdrawn, the manipulating arm assembly 228 is located in the position 228' with the head in position 231' and the suction and blowing jet with the grasped leading end of sliver (not shown) in the position 232'. The manipulating arm assembly 228 moves clockwise out of the position 228' in the direction of the arrow 297 into the position for supplying the sliver to the condenser 3, during which the suction and blowing jet 232 with the grasped sliver end moves in the arcuate pivot path 291.

When the manipulating arm assembly 228 is in the position 228', the roller 226 of the slide 220 has left the cam surface 292 and at the same time the bar 213 is again positioned above the pin 214. After the final disengagement of the roller 226 from the cam surface 292, the pin 214 re-engages in the hole 215 of the bar 213 so that the holder 246 is again locked during the continuing pivotal movement of the manipulating arm assembly 228 and the delivery of the sliver end to the condenser 3.

It is also contemplated as an alternative to the pivoting movement of the manipulating arm assembly 228 described above that the manipulating arm assembly may be arranged to move in a full circular path in the direction of the arrow 290 to retrieve the leading end of sliver and deliver it to the condenser at a spinning position into the supply location for the sliver. To accomplish this manner of operation, the control for moving the head with the suction and blowing jet radially inward and outward must be appropriately modified. Specifically, as early as the position 228' of FIG. 12 in the rotational path 290, a suction air force must be generated at the suction and blowing jet. The extension of the suction and blowing jet should not take place along the path 293 by means of a sudden release initiated by release of the bar 213 but rather should occur in a controlled fashion by means of the pneumatic cylinder 249 along the path 298 in the direction opposite to that shown in FIG. 12 and described above. The full extent of the cam surface 292 would then have to be travelled over by the roller 226 and in the position in which the manipulating arm assembly 228 is shown in full lines in FIG. 12 a withdrawal of the head with the suction and blowing jet by means of the pneumatic cylinder 249 would then have to take place for purposes of locking the holder 246. Also, for such a procedure when searching for and drawing in the leading end of the sliver by means of suction, the clamp for the sliver on the sliver cam would have to be open in the direction opposite that which is necessary for the procedure first described above.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a method for supplying a sliver from a filled sliver container to a spinning position of a spinning machine wherein a leading end of the sliver is introduced by a manipulator into a sliver supply location of the spinning position, the improvement comprising the steps of suctioning the leading end of the sliver at a defined position on the sliver container and fixing the leading end of the sliver, moving the leading end of the sliver into a position in front of the sliver supply location of the spinning position, opening the sliver supply location, releasing the leading end of the sliver from the suctioning and blowing the leading end of the sliver into the open sliver supply location, closing the sliver supply location, clamping the leading end of the sliver into the sliver supply location, and starting the spinning position.

2. The method according to claim 1 wherein the step of starting the spinning position comprises operating the spinning position for a predetermined time to spin a yarn by the spinning position, then stopping the spinning position and removing the spun yarn, and then restarting the spinning position, winding the yarn spun thereby and evaluating the wound yarn.

3. The method according to claim 2 and further comprising the step of determining whether the leading end of the sliver has been successfully introduced into the sliver supply location of the spinning position based on the step of evaluating the wound yarn.

4. The method according to claim 1 and further comprising the steps of positioning the manipulator in an initial position at the spinning position and then positioning the manipulator precisely relative to the sliver supply location of the spinning location.

5. The method according to claim 4 wherein the step of positioning the manipulator precisely relative to the sliver supply location of the spinning position comprises sensing any positional deviation of the manipulator in relation to the spinning position and correcting any sensed positional deviation before initiating the suctioning step.

6. The method according to claim 1 and further comprising the steps of providing the manipulator with suction means, moving the suction means of the manipulator in a first arcuate path from an initial position toward the leading end of the sliver on the sliver container, during the first arcuate movement of the suction means repositioning the suction means on the manipulator to follow a second arcuate path of movement of a larger radius, moving the suction means past the leading end of the sliver on the sliver container, then moving the suction means back toward the leading end of the sliver on the sliver container while repositioning the suction means to return to the first arcuate path when passing the area of the leading end of the sliver on the sliver container for suction grasping of the leading end of the sliver.

7. The method according to claim 1 and further comprising the steps of providing the manipulator with suction means, moving the suction means of the manipulator in a first arcuate path from an initial starting position toward the leading end of the sliver on the sliver container, and, when passing the area of the leading end of the sliver on the sliver container, repositioning the suction means on the manipulator to follow a second arcuate path of movement of a larger radius to dispose the suction means for suction grasping of the leading end of the sliver, and then repositioning the suction means to return to the first arcuate path of movement.

8. In an apparatus for supplying a sliver from a filled sliver container to a spinning position of a spinning machine wherein a manipulator is provided for introducing a leading end of the sliver into a sliver supply location of the spinning position, the improvement wherein the manipulator comprises means for suctioning the leading end of the sliver at a defined position on the sliver container and fixing the leading end of sliver, means for moving the suctioning means to move the leading end of the sliver into a position in front of the sliver supply location of the spinning position, means for opening and closing the sliver supply location, and means for releasing the leading end of the sliver from the suctioning means and for blowing the leading end of the sliver into the open sliver supply location.

9. The apparatus according to claim 8 and further comprising a service unit for traveling movement along plural spinning positions of the spinning machine, the manipulator being mounted on the service unit for movement between an initial resting position, a position for receiving the leading end of the sliver at the defined position on the sliver container and a position for introducing the sliver into the sliver supply location of a spinning position.

10. The apparatus according to claim 9 wherein said suctioning means and said blowing means share a common air hose opening at a head portion of the manipulator and means for selectively extending the air hose from the head portion into the sliver supply location of the spinning position.

11. The apparatus according to claim 9 wherein the manipulator is arranged for movement on the service unit to operate with respect to two successive sliver containers for two adjacent spinning positions for introducing sliver to the respective two adjacent spinning positions from a single position of the service unit.

12. The apparatus according to claim 9 wherein the service unit includes a device for replacing sliver containers at the spinning positions of the spinning machine and the manipulator is located on the container replacement device.

13. The apparatus according to claim 8 and further comprising a switchable valve for alternatively applying suction to said suctioning means and forced air flow to said blowing means.

14. The apparatus according to claim 8 and further comprising sensing means for determining a positional deviation of the manipulator between an initial position thereof at the spinning position and a theoretical position relative to the spinning position and means for positionally adjusting the manipulator with respect to the spinning position to correct any positional deviation.

15. The apparatus according to claim 8 wherein the manipulator includes means for moving the suction means of the manipulator in a first arcuate path from an initial position toward the leading end of the sliver on the sliver container, means for repositioning the suction means on the manipulator during the first arcuate movement of the suction means to follow a second arcuate path of movement of a larger radius, means for moving the suction means past the leading end of the sliver on the sliver container, means for moving the suction means back toward the leading end of the sliver on the sliver container and means for repositioning the suction means to return to the first arcuate path when passing the area of the leading end of the sliver on the sliver container for suction grasping of the leading end of the sliver.

16. The apparatus according to claim 8 wherein the manipulator comprises means for moving the suction means of the manipulator in a first arcuate path from an initial starting position toward the leading end of the sliver on the sliver container, means for repositioning the suction means on the manipulator to follow a second arcuate path of movement of a larger radius when passing the area of the leading end of the sliver on the sliver container to dispose the suction means for suction grasping of the leading end of the sliver, and means for repositioning the suction means to return to the first arcuate path of movement.

* * * * *